US008869709B2

(12) United States Patent
East et al.

(10) Patent No.: US 8,869,709 B2
(45) Date of Patent: Oct. 28, 2014

(54) HIGH FRICTION RAILROAD CAR COMPONENTS WITH FRICTION MODIFYING INSERTS

(75) Inventors: David M. East, Libertyville, IL (US); Giuseppe Sammartino, Arlington Heights, IL (US); Michael K. Burke, Wheaton, IL (US)

(73) Assignee: Standard Car Truck Company, Park Ridge, IL (US)

( * ) Notice: Subject to any disclaimer, the term of this patent is extended or adjusted under 35 U.S.C. 154(b) by 148 days.

(21) Appl. No.: 13/568,745

(22) Filed: Aug. 7, 2012

(65) Prior Publication Data

US 2013/0199407 A1 Aug. 8, 2013

Related U.S. Application Data

(60) Provisional application No. 61/522,053, filed on Aug. 10, 2011.

(51) Int. Cl.
*B61F 5/50* (2006.01)
*B61F 5/12* (2006.01)

(52) U.S. Cl.
CPC .. *B61F 5/50* (2013.01); *B61F 5/122* (2013.01)
USPC ..... 105/198.2

(58) Field of Classification Search
CPC ..... B61F 5/122
USPC ..... 105/157.1, 198.2, 198.5
See application file for complete search history.

(56) References Cited

U.S. PATENT DOCUMENTS 3,092,215 A 6/1963 Haydu
3,589,529 A 6/1971 Altherr
3,599,574 A 8/1971 Robertson
3,712,691 A 1/1973 Cope
3,748,001 A 7/1973 Neumann et al.
3,759,400 A 9/1973 Cope
3,762,338 A 10/1973 Dwyer
3,802,353 A 4/1974 Korpics
3,832,954 A 9/1974 Amwake
3,834,774 A 9/1974 Fiegl
4,084,514 A 4/1978 Bullock
4,192,240 A 3/1980 Korpics
4,244,298 A 1/1981 Hawthorne et al.
4,463,835 A 8/1984 Murphy et al.
4,480,721 A 11/1984 Murphy
4,739,889 A 4/1988 Bomgardner
4,741,085 A 5/1988 Bomgardner (Continued)

OTHER PUBLICATIONS

Office Action for U.S. Appl. No. 13/087,559 dated Mar. 29, 2013.

(Continued)

*Primary Examiner* — Zachary Kuhfuss
(74) *Attorney, Agent, or Firm* — Neal, Gerber & Eisenberg LLP

(57) ABSTRACT

High friction railroad car components with component friction modifying inserts which are configured to coat an engagement surface on a corresponding component on the railroad car to modify or control the friction between an engagement surface of the high friction railroad car component and the engagement surface of the corresponding component while allowing such components to engage each other. The initial movement of the high friction component with the friction modifying inserts causes transfer material of the friction modifying inserts to be spread over or coat a portion of the engagement surface of the corresponding component. This forms a lubrication layer which modifies or controls the friction between these components while these components are in engagement.

35 Claims, 44 Drawing Sheets

(56) References Cited

U.S. PATENT DOCUMENTS

| | | | |
|---|---|---|---|
| 4,784,068 | A | 11/1988 | Burke |
| 4,795,007 | A | 1/1989 | Murphy et al. |
| 4,913,062 | A | 4/1990 | Burke |
| 4,917,021 | A | 4/1990 | Murphy |
| 4,953,471 | A | 9/1990 | Wronkiewicz et al. |
| 5,086,707 | A | 2/1992 | Spencer et al. |
| 5,158,694 | A | 10/1992 | Waynick |
| 5,165,714 | A | 11/1992 | Kaim |
| 5,213,697 | A | 5/1993 | Vinci et al. |
| 5,239,933 | A | 8/1993 | Murphy et al. |
| 5,305,694 | A | 4/1994 | Wronkiewicz et al. |
| 5,305,899 | A | 4/1994 | Kaufhold |
| 5,386,783 | A | 2/1995 | Rhen et al. |
| 5,404,826 | A | 4/1995 | Rudibaugh et al. |
| 5,415,108 | A | 5/1995 | Murphy et al. |
| 5,452,665 | A | 9/1995 | Wronkiewicz et al. |
| 5,511,489 | A | 4/1996 | Bullock |
| 5,555,818 | A | 9/1996 | Bullock |
| 5,562,045 | A | 10/1996 | Rudibaugh et al. |
| 5,579,697 | A | 12/1996 | Burke |
| 5,598,936 | A | 2/1997 | Murphy |
| 5,601,031 | A | 2/1997 | Carlson |
| 5,669,745 | A | 9/1997 | Anderson |
| 5,682,964 | A | 11/1997 | Murphy |
| 5,687,650 | A | 11/1997 | Murphy |
| 5,694,859 | A | 12/1997 | Burke et al. |
| 5,701,825 | A | 12/1997 | Peach |
| 5,749,301 | A | 5/1998 | Wronkiewicz et al. |
| 5,791,258 | A | 8/1998 | Hawthorne et al. |
| 5,799,582 | A | 9/1998 | Rudibaugh et al. |
| 5,868,384 | A | 2/1999 | Anderson |
| 5,875,721 | A | 3/1999 | Wright et al. |
| 5,908,001 | A | 6/1999 | Burke et al. |
| 5,940,889 | A | 8/1999 | Shirai |
| 5,975,818 | A | 11/1999 | Burke et al. |
| 6,050,199 | A | 4/2000 | Anderson et al. |
| 6,068,146 | A | 5/2000 | Trent et al. |
| 6,092,470 | A | 7/2000 | O'Donnell |
| 6,136,240 | A | 10/2000 | Burke et al. |
| 6,141,853 | A | 11/2000 | O'Donnell |
| 6,142,082 | A | 11/2000 | Burke et al. |
| 6,148,734 | A | 11/2000 | Gwinn |
| 6,199,708 | B1 | 3/2001 | Monaco |
| 6,276,283 | B1 | 8/2001 | Weber |
| 6,341,422 | B1 | 1/2002 | O'Donnell |
| 6,367,590 | B1 | 4/2002 | Burke |
| 6,374,749 | B1 | 4/2002 | Duncan et al. |
| 6,425,334 | B1 | 7/2002 | Wronkiewicz et al. |
| 6,446,820 | B1 | 9/2002 | Barker et al. |
| 6,471,211 | B1 | 10/2002 | Garnett et al. |
| 6,553,917 | B1 | 4/2003 | Burke et al. |
| 6,561,740 | B1 | 5/2003 | Burke et al. |
| 6,609,830 | B2 | 8/2003 | Bank et al. |
| 6,644,214 | B1 | 11/2003 | Schorr |
| 6,688,236 | B2 | 2/2004 | Taillon |
| 6,691,625 | B2 | 2/2004 | Duncan |
| 6,701,850 | B2 | 3/2004 | McCabe et al. |
| 6,708,624 | B2 | 3/2004 | Faryniak et al. |
| 6,786,160 | B1 | 9/2004 | Peach et al. |
| 6,792,871 | B2 | 9/2004 | O'Donnell et al. |
| 6,792,874 | B1 | 9/2004 | Anderson et al. |
| 6,805,523 | B2 | 10/2004 | Burke et al. |
| D497,838 | S | 11/2004 | Anderson |
| 6,862,999 | B2 | 3/2005 | O'Donnell et al. |
| 6,877,623 | B2 | 4/2005 | Salis |
| 6,957,611 | B2 | 10/2005 | O'Donnell et al. |
| 6,964,233 | B2 | 11/2005 | Peach et al. |
| 6,971,319 | B2 | 12/2005 | Bowden |
| 7,083,165 | B2 | 8/2006 | Palinkas |
| 7,121,212 | B2 | 10/2006 | Schorr |
| 7,128,312 | B2 | 10/2006 | Salis |
| 7,244,695 | B2 | 7/2007 | Eadie |
| 7,275,487 | B2 | 10/2007 | O'Donnell et al. |
| RE39,998 | E | 1/2008 | Francois |
| 7,328,659 | B2 | 2/2008 | Forbes |
| 7,338,034 | B2 | 3/2008 | Aspengren et al. |
| 7,389,731 | B2 | 6/2008 | Rudibaugh et al. |
| 7,469,641 | B2 | 12/2008 | Berg et al. |
| 7,513,199 | B2 | 4/2009 | Van Auken |
| 7,513,295 | B2 | 4/2009 | Poncin et al. |
| 7,527,003 | B1 | 5/2009 | Schorr et al. |
| 7,540,387 | B2 | 6/2009 | Sommerfeld |
| 7,546,807 | B2 | 6/2009 | Johnstone et al. |
| 7,549,379 | B2 | 6/2009 | Monaco et al. |
| 7,568,584 | B2 | 8/2009 | Brough et al. |
| 7,802,524 | B1 | 9/2010 | Gregar |
| 7,837,046 | B2 | 11/2010 | Brewster |
| 7,845,288 | B2 | 12/2010 | Forbes et al. |
| 7,935,431 | B2 | 5/2011 | Poncin et al. |
| 8,147,980 | B2 | 4/2012 | Bhide |
| 2002/0073880 | A1 | 6/2002 | Wronkiewicz et al. |
| 2003/0106456 | A1 | 6/2003 | Faryniak et al. |
| 2005/0087092 | A1 | 4/2005 | McKisic et al. |
| 2008/0011700 | A1 | 1/2008 | Brough et al. |
| 2008/0035012 | A1 | 2/2008 | Monaco et al. |
| 2012/0261218 | A1 | 10/2012 | Marlow et al. |

OTHER PUBLICATIONS

International Search Report for PCT Publication No. WO2012/142081, mailed on Sep. 24, 2012, five pages.

HIGH FRICTION RAILROAD CAR COMPONENTS WITH FRICTION MODIFYING INSERTS

PRIORITY CLAIM

This application is a non-provisional of, and claims priority to and the benefit of, U.S. Provisional Patent Application No. 61/522,053, filed on Aug. 10, 2011, the entire contents of which are incorporated herein by reference.

BACKGROUND

The railroad industry employs a large variety of freight railroad cars for transporting various different products. Each freight railroad car typically has hundreds, if not thousands, of different components. Certain of these freight railroad car components are considered to be railroad car high friction components because they are configured and positioned in the railroad car to engage under pressure a corresponding railroad car component of the railroad car while one or both of these components move relative to each other. For brevity, each railroad car high friction component is referred to herein as the high friction component, and the corresponding railroad car component is referred to herein as the corresponding component. For each high friction component and its corresponding component, when one or both of these engaging components move relative to one another, a certain amount of friction is created or exists between these engaging components. The friction between each high friction component and its corresponding component serves an important function in the control of the railroad car during movement of the railroad car along the tracks. One such important function is to provide appropriate damping characteristics to control ride quality of the railroad car.

Each high friction component and its corresponding component are preferably configured such that the amount of friction created between that high friction component and its corresponding component is at an optimal amount or within an optimal range. If the amount of friction is at the optimal amount or within the optimal range, these components best perform their intended functions. If the amount of friction between a high friction component and its corresponding component is slightly above the optimal amount or above the optimal range, or is slightly below the optimal amount or below the optimal range, these engaging components will typically operate, but will not optimally operate to provide their intended functions. Such non-optimal operation causes many problems such as, but not limited to: (a) excessive wear on these components; (b) excessive wear on other components of the railroad car; (c) excessive use of fuel which also creates excessive environmental pollution; (d) premature maintenance cycles; and (e) periodic lube cycles. If the amount of friction between a high friction component and its corresponding component is substantially above the optimal amount or above the optimal range, or is substantially below the optimal amount or below the optimal range, these components may not operate within maximum or minimal acceptable levels of providing their intended functions, or may not operate at all.

For each different high friction component, many different factors typically affect the amount of friction created between that high friction component and it corresponding component during operation of the railroad car. Certain of these factors also change over time as the railroad car is in service, as environment conditions change, and as these components and other components of the railroad car wear. It should thus be appreciated that it is very difficult for railroad car builders or railroad car component builders, for each high friction component, to have that high friction component operate at an optimal amount or with the optimal range.

While various different components of freight railroad cars are typically high friction components, the present disclosure uses friction wedges, constant contact side bearings, truck bolster center bowl liners, and brake beam extension heads as examples of such high friction components. It should however be appreciated that the problems with such high friction components discussed herein and the solutions to such problems discussed herein are not limited to such example components.

More specifically, previously known railroad car friction wedges provided metal to metal contact between the engagement face of the friction wedge and the corresponding engagement surface of the side frame column. This metal to metal contact produced very high (i.e., substantially above optimal) amounts of friction between these components and caused high rates of wear on their engaging surfaces. This metal to metal contact often created a slip stick effect that was hard to control and which often significantly varied with environmental changes (such as dramatic temperature swings or humidity changes). This metal to metal contact and the resulting problems made freight railroad car ride quality less controllable and failed to provide optimal operation of freight railroad car suspensions.

To solve these problems resulting from this undesired metal to metal contact between friction wedges and their corresponding side frame columns, certain friction wedges have been made with friction reducing pads bonded or otherwise attached to the entire or substantially the entire face of the friction wedge. Examples of these pads are disclosed in U.S. Pat. Nos. 6,691,625; 6,688,236; 6,701,850; 6,971,319; and 7,389,731. These friction reducing pads are placed between the engaging surfaces of the high friction component and the corresponding component, thereby separating these surfaces and preventing metal to metal contact between these components.

Known friction wedges with these pads have certain disadvantages. First, adding these pads to the friction wedges significantly increases the cost of the friction wedges. For example, for the friction wedges which include pads bonded to the engagement surface, the bonding process is relatively costly at least because it involves multiple manufacturing steps to effectuate the bond. Second, the bonded pads are prone to chipping and delaminating from the friction wedge engagement face. For example, failure of the material of the pad can occur from edge loading. Third, these pads are generally employed as sacrificial elements which are configured and manufactured to be worn out and replaced after certain periods of time or service. The need to regularly replace these worn, damaged, or destroyed pads increases the overall maintenance needed for freight railroad cars employing such friction wedges with these pads, and thus increases the overall cost of operating the freight railroad cars with such friction wedges. Fourth, the composite material of these pads is also more compressible than the respective metal engagement surfaces or faces of the friction wedges and corresponding components. Such compressibility of the material of the pad attached to the face of the friction wedge can sacrifice the ability of the friction wedge to hold the truck in a square position (which is sometimes called the warp damping/stiffness characteristic). Fifth, eliminating the metal to metal contact between these engaging components eliminates the advantages provided by such metal to metal contact, and particularly the overall strength and pressure tolerances of such metal, and particularly, such steel components. Accordingly, there is a need for railroad car friction wedges which overcome the above problems.

As mentioned above, another example high friction component with various disadvantages is a railroad car constant contact side bearing. Known constant contact side bearings generally create a higher truck torque that enables the truck to better handle curves in the tracks and high speed stability. Previously employed constant contact side bearings also provided metal to metal contact with the mating surfaces of the car underbody (or wear plate thereon) which produced high (i.e., substantially above optimal) amounts of friction between these engaging metal surfaces and caused high rates of wear on these engaging metal surfaces. Constant contact side bearings with sacrificial wear pads have also been also employed to reduce such undesired high amounts of friction between these metal surfaces. However, similar to friction wedges with these pads, constant contact side bearings with sacrificial wear pads are likewise more costly to manufacture, susceptible to chipping and delaminating, and eliminate the advantages provided by metal to metal engagement. Accordingly, there is also a need for constant contact side bearings which overcome these problems.

It should be appreciated from the above discussion of high friction components, such as friction wedges and constant contact side bearings, that there is an overall need for better railroad high friction components such as, but not limited to: (a) friction wedges; (b) constant contact side bearings; (c) bowl liners; (d) brake beam extension heads; (e) roller bearing adapters; (f) roller bearing adapter liners; and (g) side bearing vertical walls.

SUMMARY

Various embodiments of the present disclosure solve the above problems by providing a high friction railroad car component with one or more component friction modifying inserts which assist in more precisely and uniformly controlling the amount of friction between the railroad car high friction component and a corresponding railroad car component. The railroad car high friction component of the present disclosure includes an engagement surface or face which is configured to mate with or engage a mating or engagement surface or face of the corresponding component on the railroad car. Each friction modifying insert is positioned in a pocket in the engagement surface or face of the high friction component and extends from the pocket beyond the plane in which that engagement surface or face lies. When the high friction component with one or more friction modifying insert(s) is initially installed in its working position in the railroad car, each of the friction modifying inserts is disposed partially in its pocket and extends toward the engagement surface or face of the corresponding component. Unlike known wear pads as described above, the friction modifying insert does not prevent the metal to metal contact between the high friction component and the corresponding component, but rather provides a lubrication for such engaging components. When either or both of the high friction component with the friction modifying insert(s) and the corresponding component move relative to each other, this movement causes certain of the material of each friction modifying insert to be spread over or to thinly coat a desired section of the engagement surface or face of the corresponding component, thus providing a lubrication between such engaging surfaces.

The material of each friction modifying insert which transfers to the engagement surface or face of the corresponding component is referred to herein as the transfer material. The transfer material of each friction modifying insert coats and forms a relatively thin lubrication layer of the friction modifying insert material in a transfer pattern on the engagement face or surface of the corresponding component. Each transfer pattern is based on the size, shape, and material of the respective friction modifying insert, and the relative directions or angles of movement of the high friction component and the corresponding component relative to each other. The transfer material spread on or coated on the corresponding component which forms the lubrication layer assists in controlling the amount friction between these engagement or mating surfaces or faces, and thus between the high friction component and the corresponding component (i.e., between the metal to metal engagement). In the embodiments where the high friction component of the present disclosure employs more than one friction modifying insert, these friction modifying inserts may be arranged such that they form an overlapping transfer pattern or separate transfer patterns and thus provide lubrication at various different engagement areas. The total friction between the parts can be tuned based on the various shapes, sizes, number of inserts, and the amount of lubrication desired from those inserts between the engaging components.

The present disclosure contemplates that the material of the friction modifying inserts (and thus the transfer material or lubrication layer) can vary based on the desired coefficient of friction (hereinafter "COF") of the friction modifying insert or lubrication layer, which in turn is at least partly based on the respective high friction component and corresponding component, and particularly on: (a) the material of the engagement surface or face of the high friction component; (b) the size and shape of that engagement surface or face; (c) the material of the engagement surface or face of the corresponding component; (d) the size and shape of that engagement surface or face; (e) the expected forces exerted on those respective engagement surfaces or faces; and (f) the amount of lubrication desired between the engaging surfaces (e.g., between the engaging steel surfaces).

The desired or optimal amount or range of friction for each high friction component and its corresponding component can be obtained by determining the desired transfer pattern (s), and the desired transfer pattern(s) can be obtained by determining the material of, size of, volume of, shape of, position of, and number of friction modifying inserts needed to create the desired transfer pattern(s). In other words, by controlling the material, size, shape, position, and quantity of friction modifying inserts, the exact transfer patterns or lubrication layer can be formed to control and thus optimize the amount of friction between the high friction component and its corresponding component. In particular, these characteristics of the friction modifying insert determine the initial lubrication when these components are initially assembled under pressure, and then the lubrication to these components during movement of the railroad cars. The present disclosure thus generally provides the ability to more precisely achieve an amount of friction between such components which is optimal or within an optimal range.

More specifically, the lubrication layer created by the transfer material from the friction modifying insert(s) enables the high friction component and the corresponding component to provide the desired damping characteristics and thus provide a better controlled ride quality. The lubrication layer formed from the friction modifying insert(s) also reduces the wear rates of the engagement or mating surfaces or faces of the high friction component and the corresponding component. The friction modifying insert(s) and the process for forming the pocket(s) in the high friction component are also less expensive than the known sacrificial wear pads described above. It should also be appreciated that the relatively thin lubrication layer formed and reformed between the engagement surfaces or faces of the high friction component and the corresponding component as these components wear minimizes the undesired interference between those engagement surfaces or faces over the entire or substantially the entire area of the transfer pattern(s) and reduces any stick slip effect.

It should be appreciated that the corresponding component in some instances can also be considered a high friction component and the present disclosure contemplates that in certain embodiments, both of these engaging components employ the friction modifying inserts of the present disclosure. Such inserts can be configured to engage each other or only engage the engagement surface of the opposing component.

It should further be appreciated that in certain embodiments of the present disclosure, the transfer material of the friction modifying insert(s) will also be spread over, coat and lubricate portions of the engagement surface or face of the high friction component. In these embodiments, in one sense, two lubrication layers are formed (i.e., one on the surface of the corresponding component as described above, and one on the surface of the high friction component) to precisely control the amount of friction between these mating or engagement surfaces or faces and thus between the high friction component and the corresponding component while still allowing engagement between these components.

Other objects, features and advantages of the present invention will be apparent from the following detailed disclosure, taken in conjunction with the accompanying sheets of drawings, wherein like reference numerals refer to like parts.

DETAILED DESCRIPTION

Various embodiments of the present disclosure provide high friction railroad car components with one or more friction modifying inserts respectively positioned in one or more pockets in the engagement surface or face of the high friction components, wherein the friction modifying inserts are configured to provide a lubrication layer assist in controlling the amount of friction between that engagement surface or face of the high friction component and a corresponding component on the railroad car (without providing a wear pad which is positioned between and separates these two engaging surfaces). The present application describes various examples of freight railroad car high friction components of the present disclosure. It should be appreciated that the present disclosure is not limited to these example railroad car high friction components. It should also be appreciated that while the lubrication is expected to be provided between engaging metal surfaces in most instances for these railroad components, one or more of the surfaces of the engaging components may not be metal.

Figure 1:
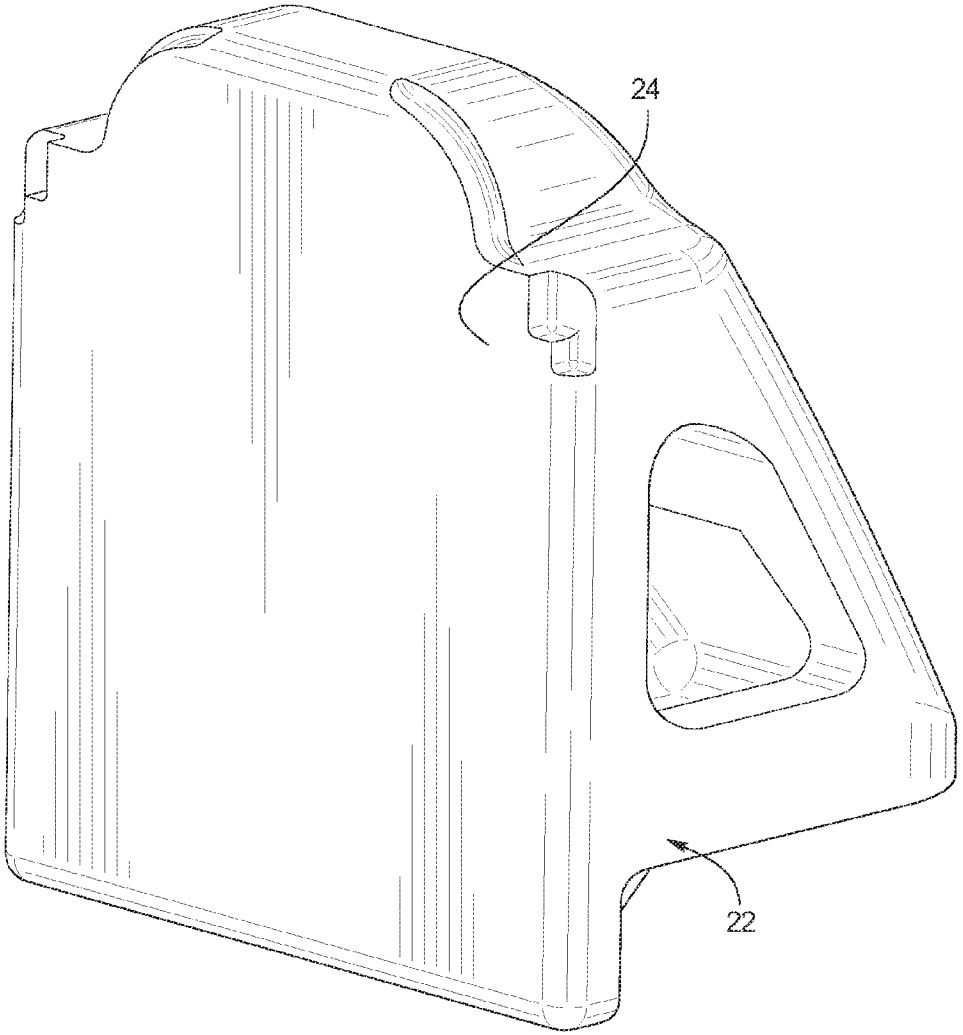
FIG. 1 (PRIOR ART)
FIG. 1 is a front perspective view of a known or prior art railroad car friction wedge with a generally vertically extending engagement face.
Figure 2:
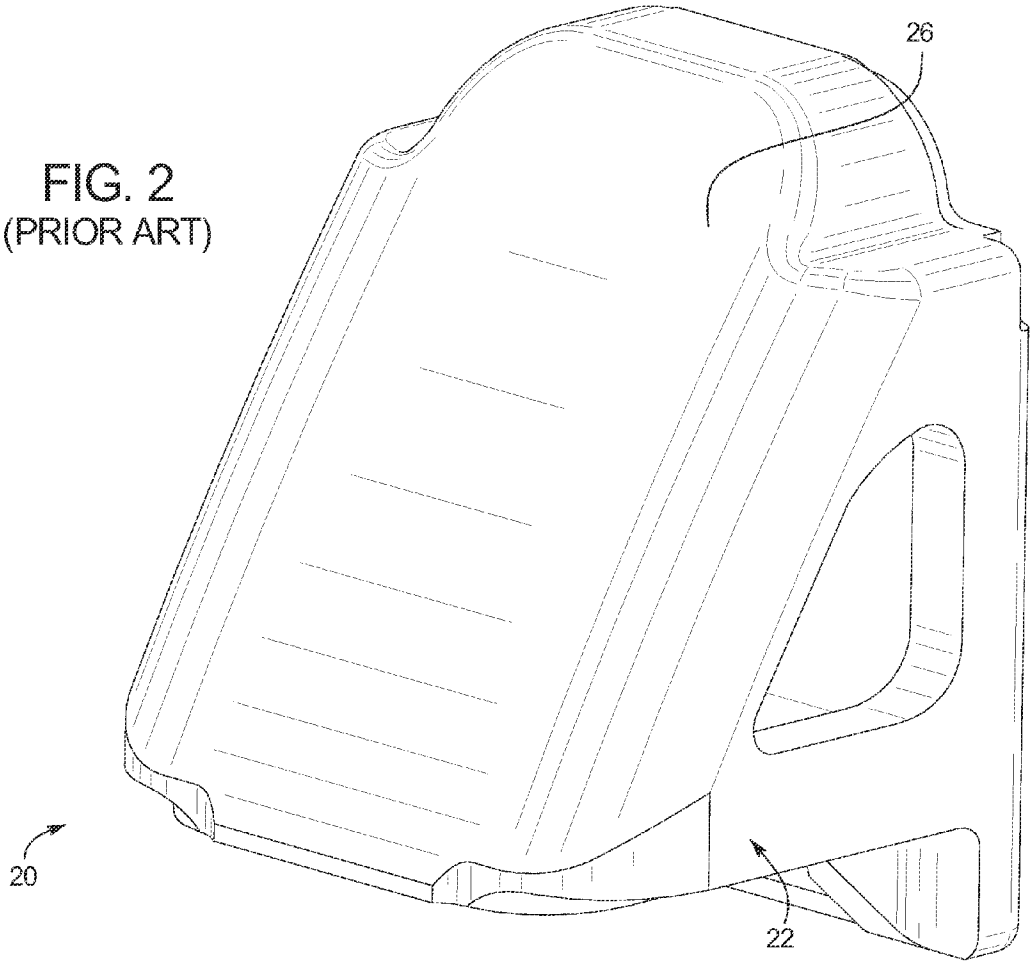
FIG. 2 (PRIOR ART)
FIG. 2 is a rear perspective view of the known or prior art railroad car friction wedge of FIG. 1.

Referring now to the drawings and particularly to FIGS. 1 and 2, one known friction wedge is generally illustrated and indicated by numeral 20. This friction wedge is an example of a railroad car high friction component. This friction wedge 20 generally includes a cast steel or cast iron body 22, an engagement face 24 on one side of the body 22, and a sloped surface 26 on the other side of the body 22. The engagement face 24 is a high friction surface because it is configured to engage an inner surface of a side frame column (not shown) of a truck (not shown) of a freight railroad car (not shown). The engagement face 24 is used herein as one of the example high friction surfaces of the present disclosure. It should be appreciated that the sloped surface 26 is also a high friction surface (even though it is not discussed herein as such). Friction wedge 20 is illustrated as an example of the type of friction wedges that can be made in accordance with the present disclosure. It should be appreciated that the present disclosure is not limited to this friction wedge or this type of friction wedge.

Figure 3:
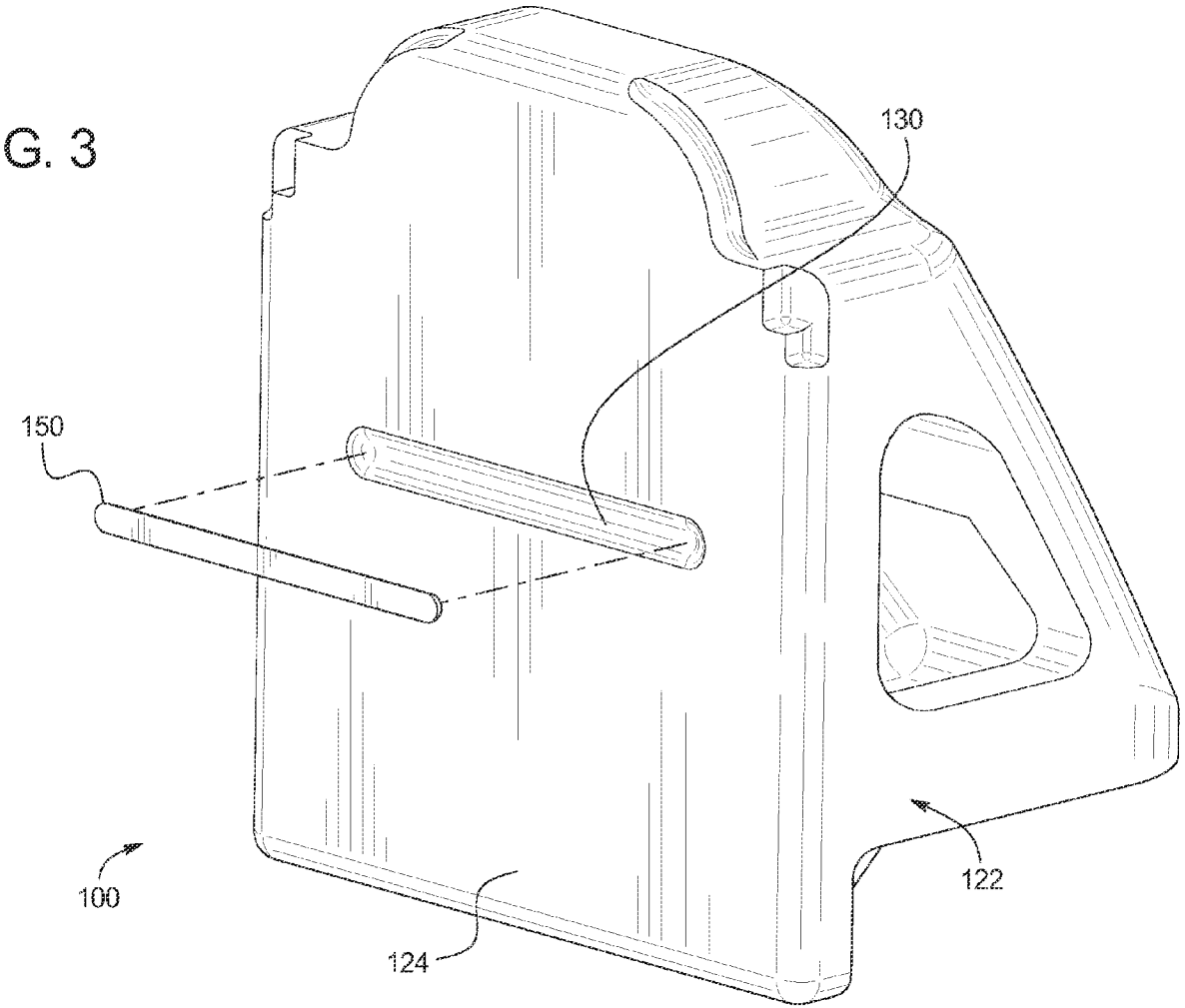
FIG. 3 is an exploded front perspective view of a railroad car friction wedge of one embodiment of the present disclosure having a friction modifying insert in the form of a single elongated bar, and a pocket configured to receive the insert.

Referring now to FIG. 3, the friction wedge 100 of one example embodiment of the present disclosure is generally illustrated. In this example embodiment, friction wedge 100 is generally the same type of friction wedge as in FIGS. 1 and 2, and further includes or defines a friction modifying insert receiving pocket 130 in its engagement face 124. In this example embodiment, the friction modifying insert 150 has an elongated oval bar shape, and the pocket 130 has a corresponding elongated oval shape, such that the pocket 130 is configured to receive the back or rear part or portion of the elongated friction modifying insert 150. The pocket 130 extends from the plane of the engagement surface 124 of the friction wedge 100 into the solid body 122 of the friction wedge 100. The pocket 130 has a depth such that the front part of the friction modifying insert 150 extends from the pocket 130 along the entire width of the friction modifying insert 150. In other words, part of the friction modifying insert 150 initially protrudes from the pocket 130 in which it is positioned and part does not protrude. It should thus be appreciated that not all of the friction modifying insert needs to protrude from the pocket in which it is positioned in accordance with the present disclosure. In various embodiments which include one or more friction modifying inserts, portions of one or more of the friction modifying inserts can be flush with the engagement surface or below the engagement surface, or a combination thereof. In the flush embodiment or when the protruding portion of the friction modifying inserts is worn down, as the two engaging metal surfaces wear, the portion in the pocket continues to provide the lubrication to these components.

It should also be appreciated that the pocket 130 can be formed in the engagement face 124 in various different suitable manners in accordance with the present disclosure. In one example embodiment, the pocket is machined into the engagement face. In another example embodiment, the pocket is formed in the engagement face during the casting of the friction wedge. The forming of the pocket does not add substantial cost to the manufacturing of this friction wedge.

Figure 3A:
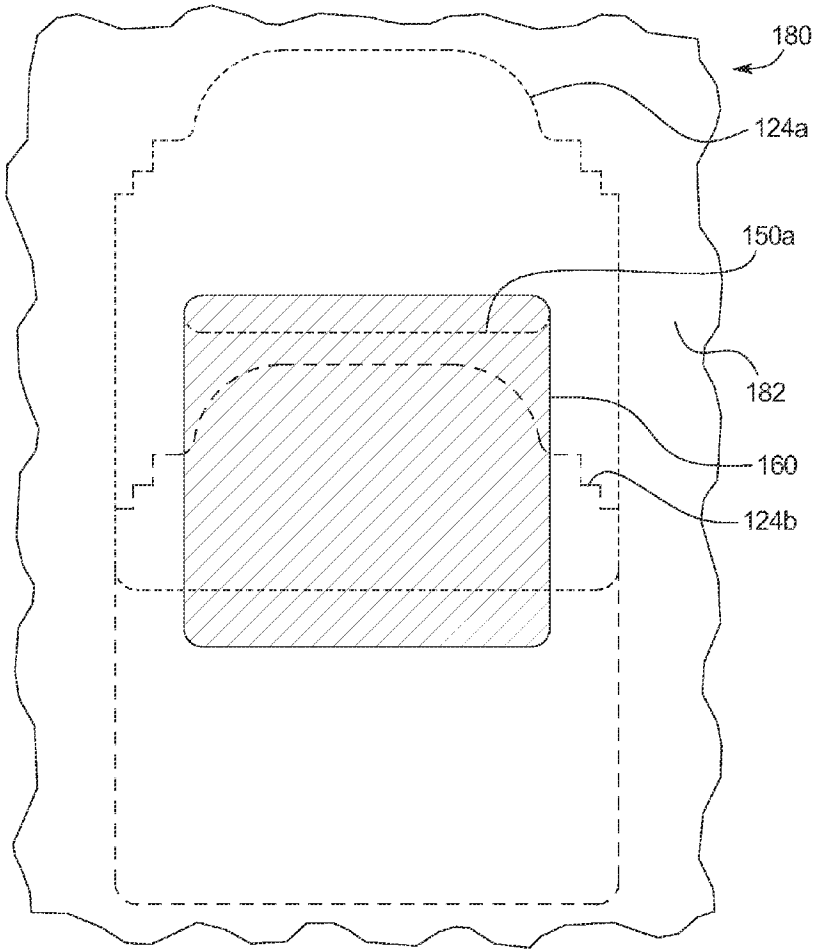
FIG. 3A is a fragmentary front view of a portion of a side frame column engaged by the friction wedge of FIG. 3, and illustrating the material transfer pattern or lubrication caused by the friction modifying insert of the friction wedge of FIG. 3.

Referring now to FIG. 3A, the material transfer pattern 160 on the inner surface 182 of the side frame column 180 caused by the friction wedge 100 of FIG. 3 is generally illustrated. More particularly, after installation, when the friction wedge 100 with the friction modifying insert 150 is initially positioned in its working position in the railroad car, the friction modifying insert 150 extends from the engagement face 124 of the friction wedge 100 (i.e., the high friction component) toward the corresponding engagement surface of the side frame column 180. When the friction wedge 100 moves up and down (and side to side) relative to the side frame column 180, this movement causes certain of the material (i.e., the transfer material) from the friction modifying insert 150 to transfer to the inner surface 182 of the side frame column 180, and more particularly to be spread over or to thinly coat a portion of the engagement surface of the side frame column 180 to lubricate these engaging components. This transfer material or lubrication adheres to the inner surface 182 of the side frame column 180 generally in transfer pattern 160 based of this movement of the friction wedge 100 relative to the side frame column 180 and based on the shape and size of the friction modifying insert 150. This transfer material forms a relatively thin lubrication layer between the friction wedge 100 and the side frame column 180, and the lubrication layer has the shape of the transfer pattern as further discussed below.

FIG. 3A illustrates in phantom the relative starting position (indicated by numeral 150*a*) of the oval shape of the friction modifying insert 150 when the friction wedge 100 is first installed in the railroad car truck and thus in the resting or home position relative to the side frame column 180. FIG. 3A further illustrates in phantom the range of downward movement (indicated by numerals 124*a* and 124*b*) of the engagement face 124 relative to the side frame column 180. It should be appreciated that the initial position (indicated by numeral 150*a*) of the friction modifying insert 150 and the range of movement of the engagement face 124 relative to the side frame column in part determines the overall transfer pattern 160. It should also be appreciated that as the transfer pattern or lubrication is formed on the side frame column 180, the portion of the friction modifying insert 150 that initially protrudes from the pocket 130 is reduced (i.e., because the transfer material of the friction modifying insert is transferred to the opposing surface).

Figure 27A:
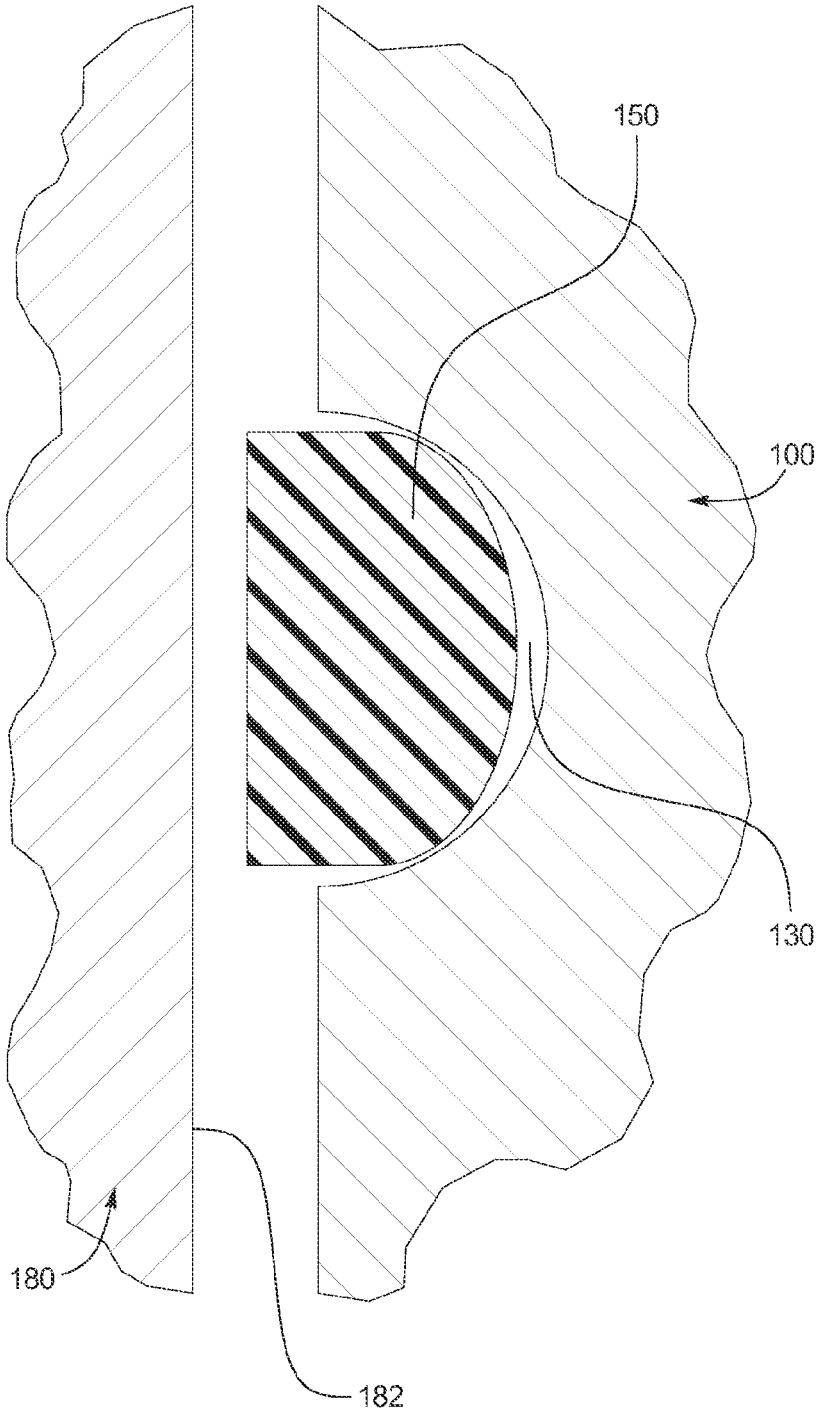
FIGS. 27A, 27B, and 27C are a series of fragmentary cross sectional views showing the wear of the friction modifying insert material and particularly the transfer material forming the lubrication layer on the surface of the corresponding component while the surfaces of the components are engaging.
Figure 27B:
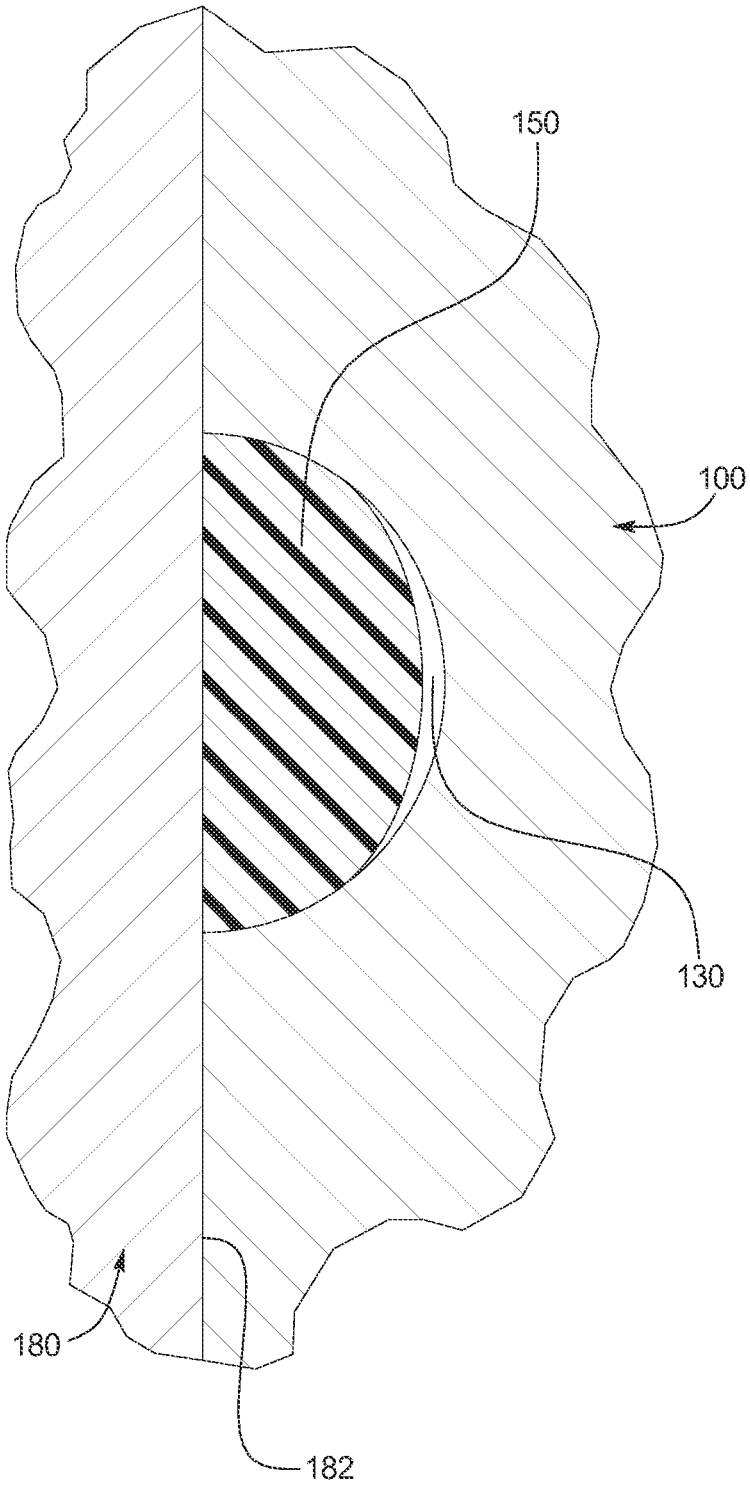
Figure 27C:
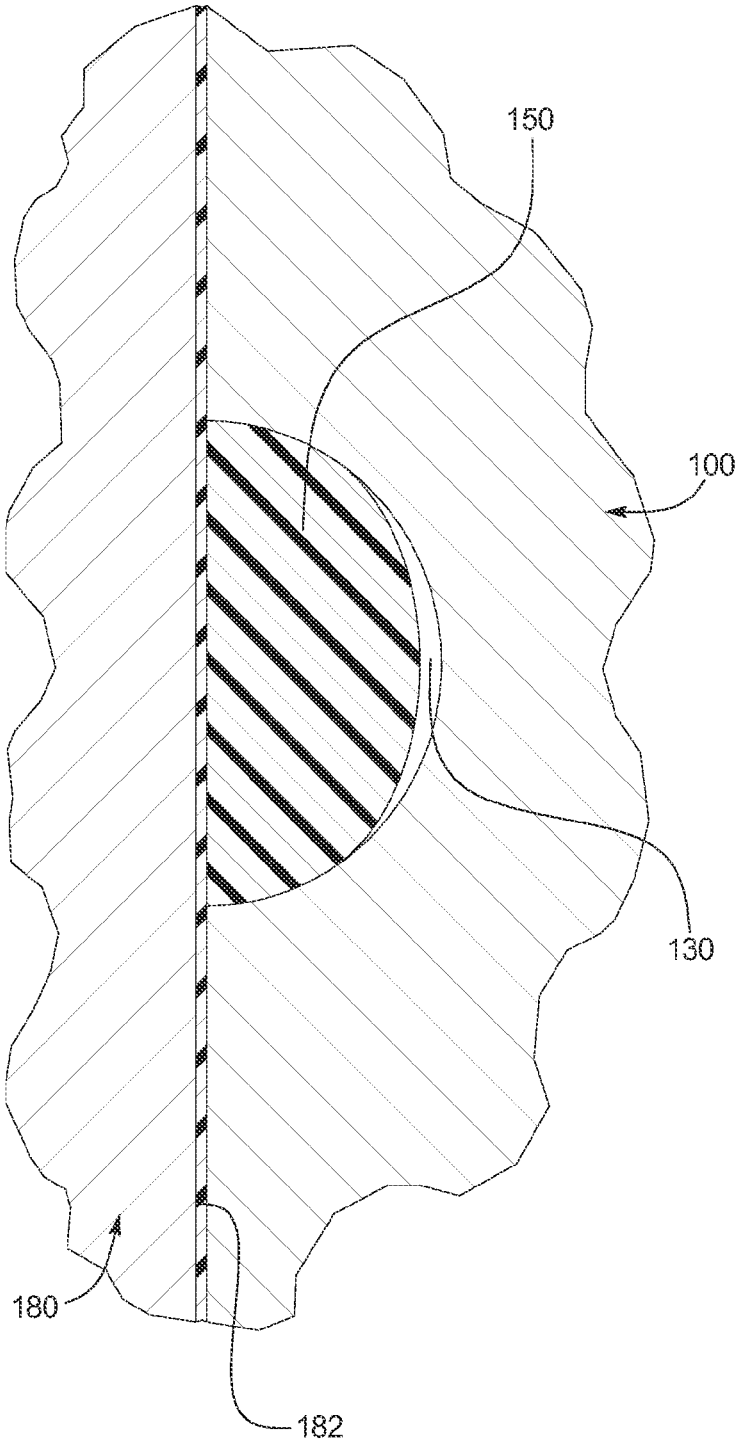

This transfer of the material is more specifically illustrated in FIGS. 27A, 27B, and 27C. These figures generally illustrate the friction modifying insert 150 positioned in pocket 130 of the friction wedge 100, and the friction wedge adjacent to and engaging the side frame column 180. These figures and particularly FIGS. 27B and 27C illustrate the compression of the friction modifying insert 150 when the two components engage and the lubricating material of the friction modifying insert 150 transferring to the inner surface 182 of the side frame column 180 to form the lubrication layer 151 in the transfer pattern. In other words, this lubrication layer is a thin film between these engaging metal surfaces. It should be appreciated that this embodiment illustrates that a relatively small volume of transfer material is employed to coat the surface of the corresponding component as the high friction component and the corresponding component move relative to one another and thereby more closely control friction.

It should be appreciated that the friction modifying inserts can be made of any suitable material that has a desired different coefficient of friction ("COF") than the friction wedge, that will readily move the transfer material or lubrication onto the engaging surface and that will adhere to the engaging surface. In certain embodiments, the friction modifying insert is made from a suitable material having a low coefficient of friction to steel, dry self-lubricating and non-hydroscopic characteristics, a high compressive strength and a high resistance to wear. In one example embodiment, the friction modifying insert is made from a high-density polyethylene (often referred to as an ultra-high molecular weight polyethylene). In another example embodiment, the friction modifying insert is made from a high density polypropylene. In other embodiments, the friction modifying insert is made from a nylon, a graphite, or a urethane such as an oil-filled urethane. It should also be appreciated that the friction modifying insert can be made from certain combinations of materials, composite materials, or can be an impregnated material. It should further be appreciated that materials with particular COF can be selected to control vertical and lateral damping characteristics to provide a controlled ride quality.

It should further be appreciated that the material of the friction modifying insert is selected in part to take into account the desired time period during which the material will aid in the friction control and/or providing the appropriate or optimal resistance throughout the usable life of the high friction component.

It should be appreciated that the friction modifying insert can be made in any suitable manner. In one example embodiment, bar shaped friction modifying inserts are manufactured in relatively long sections using a conventional extrusion die process and cut to the desired length. It should be appreciated that the friction modifying inserts of the present disclosure can be formed from alternative methods such as injection molding and that the employed manufacturing process will in part depend on the shape, size, and material of the friction modifying insert.

In the illustrated embodiment of FIGS. 3 and 3A, the friction modifying insert is generally rectangular (when viewed from an end) with a curved back side. This example insert is about the size of a standard pencil, but can certainly vary. It should however be appreciated that the friction modifying insert can be alternatively shaped in accordance with the present disclosure. For example, the friction modifying insert may alternatively be cylindrical. It should also be appreciated that the present disclosure contemplates a combination of differently shaped friction modifying inserts and individual inserts which vary in shape. It should also be appreciated that: (a) the material of the friction modifying insert; (b) the shape and configuration or volume of the friction modifying insert including its height, width, and depth; and (c) the depth of the pocket and how far, if at all, the friction modifying insert protrudes from the pocket can each be specifically selected to determine the transfer pattern or lubrication desired to optimize the amount of friction between the high friction component and the corresponding component of the railroad car.

Each friction modifying insert is configured to be placed in the respective pocket. In certain embodiments, each the friction modifying insert is pressure fit into the respective pocket. In other embodiments, one or more suitable insert holders can be employed to hold each friction modifying insert in the respective pocket during assembly, transportation, storage, and installation of the friction wedge. Once the friction wedge is installed in the truck, the position of the friction wedge and the engagement with corresponding component prevents the friction modifying insert(s) from falling out of the pocket(s). Thus, in certain embodiments, only a temporary hold is necessary for the friction modifying inserts during transportation and installation. Once the high friction component is installed, the corresponding component does not enable the friction modifying insert to fall out of place.

Figure 29:
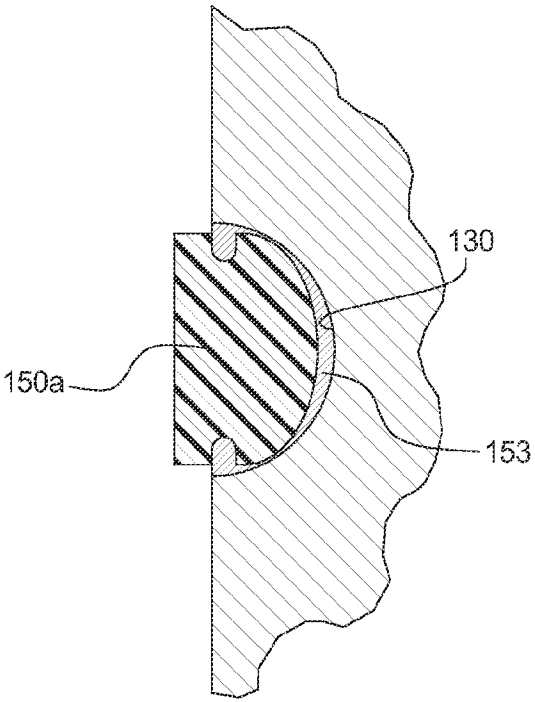
FIG. 29 is an enlarged fragmentary cross sectional view of one embodiment of the friction modifying insert positioned in a friction modifying insert pocket, and held in the pocket by an adhesive.
Figure 28:
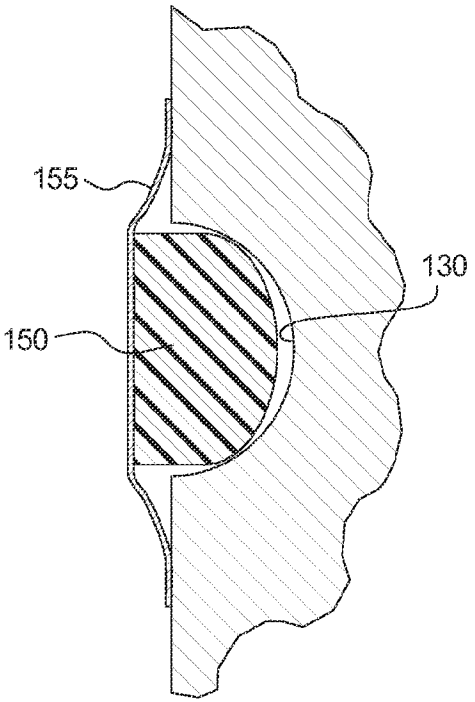
FIG. 28 is an enlarged fragmentary cross sectional view of one embodiment of the friction modifying insert positioned in a friction modifying insert pocket, and held in the pocket by a disposable or sacrificial tape.
Figure 31:
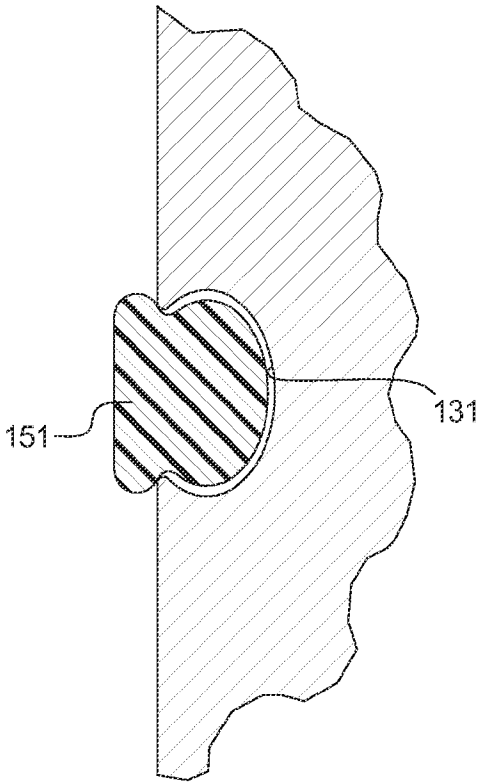
FIG. 31 is a cross sectional view of the pocket of FIG. 30 with an friction modifying insert snap fit in the pocket.
Figure 30:
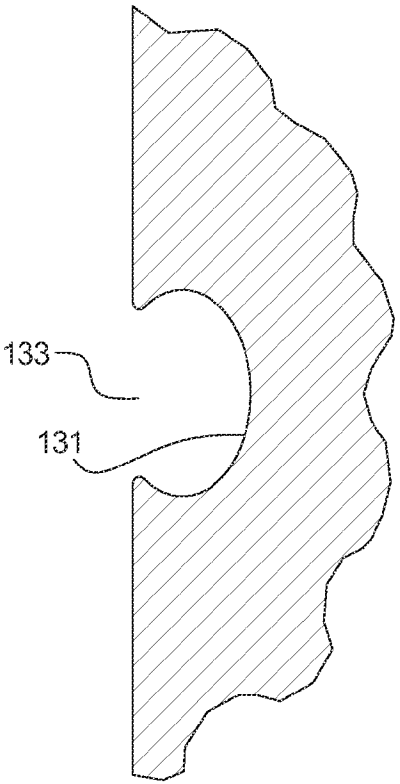
FIG. 30 is a cross sectional view of another embodiment of the pocket for holding the friction modifying insert.

More specifically, the friction modifying insert can be held in the pocket in any one or more of a variety of different manners. For example, FIGS. 28 and 29 illustrate two such example alternatives. More specifically, FIG. 28 generally illustrates a section of tape 155 holding the friction modifying insert 150 in the pocket 130. FIG. 29 generally illustrates an adhesive 153 holding the friction modifying insert 150*a* in the pocket 130. The adhesive can be any suitable adhesive. It should also be appreciated that insert 150*a* is alternatively formed with grooves which enables the adhesives to better engage the top and bottom surfaces of the insert 150*a*. It should be appreciated that in alternative embodiments, one or more of the surfaces of the pocket or insert are roughened or not smooth to create a better engagement between the insert and the walls of the pocket. In other embodiments, the insert may be formed in the pocket (such as by pouring the liquid form of the insert material into the pocket. In such instances, suitable jigs may need to be employed to form the transfer material which extends from the pocket. It should also be appreciated that the shape of the friction modifying insert and the pocket may vary in part based on the mechanism employed to hold the insert in the pocket. It should further be appreciated that the friction modifying insert may be snap or force fit into the pocket as generally illustrated in FIGS. 30 and 31. More specifically, FIG. 30 generally illustrates a pocket 131 defining a narrow opening 133, and FIG. 31 generally illustrates a friction modifying insert 151 snapped into the pocket 131. In one embodiments, a suitable core with a bulb shaped extension can be used to form the pocket during casting.

As mentioned above, the lubrication layer formed by the transfer material of the friction modifying insert provides several advantages. The lubrication layer formed by the transfer material of the friction modifying insert reduces the amount of the stick slip action between the friction wedge (i.e., the high friction component in this example) and the side frame column (i.e., corresponding component in this example) while still allowing engagement between these components, and thus provides a more controlled and improved ride quality. The lubrication layer formed by the transfer material of the friction modifying insert also does not sacrifice the ability the friction wedge to hold the truck in square position (i.e., does not sacrifice the warp damping/stiffness) in part because these components still engage each other. The lubrication layer formed by the transfer material of the friction modifying insert also reduces the wear rates of the respective engagement surfaces of the friction wedge (i.e., the high friction component in this example) and the side frame column (i.e., corresponding component in this example).

Figure 4:
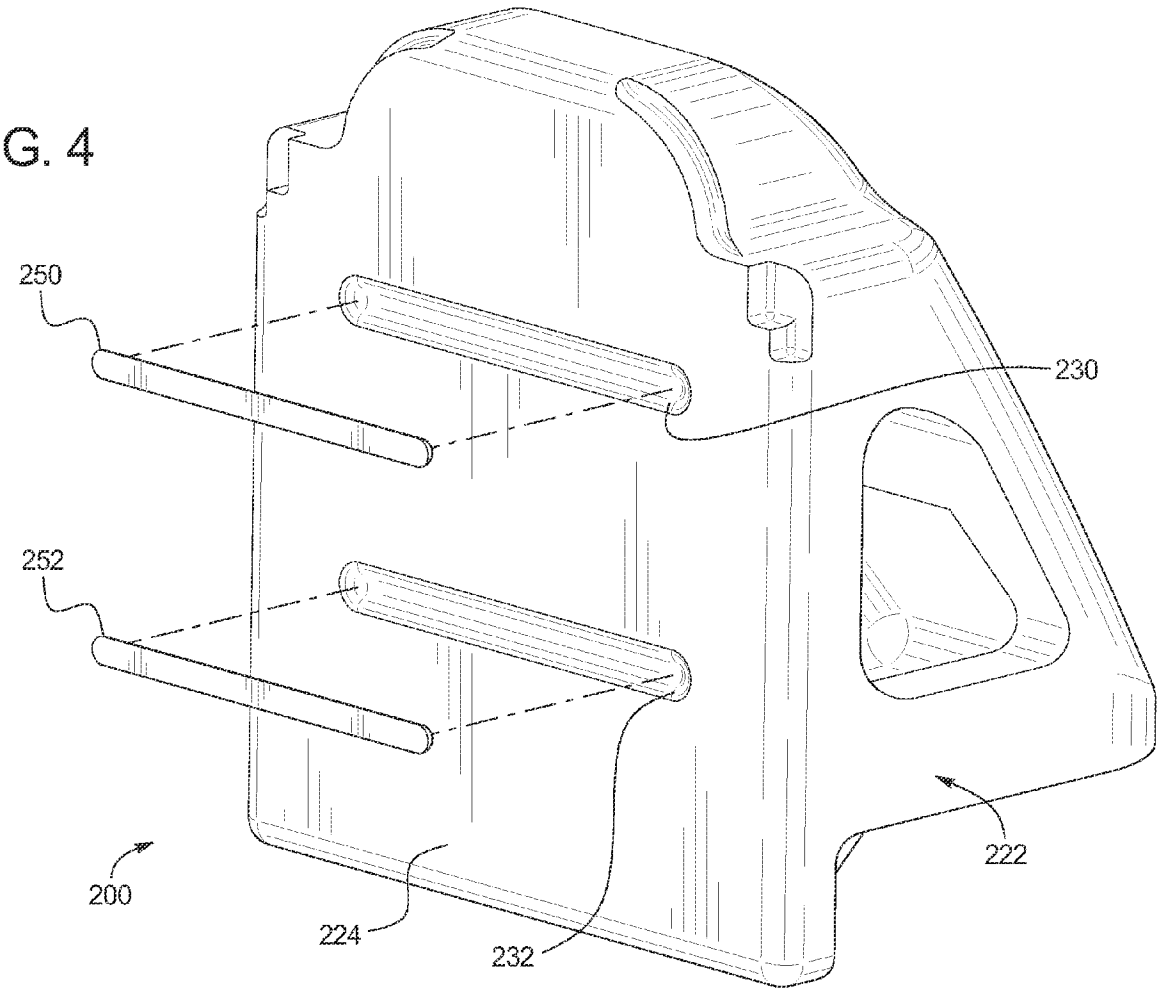
FIG. 4 is an exploded front perspective view of a railroad car friction wedge of another embodiment of the present disclosure having friction modifying inserts in the form of a pair of spaced apart elongated bars and corresponding pockets.
Figure 4A:
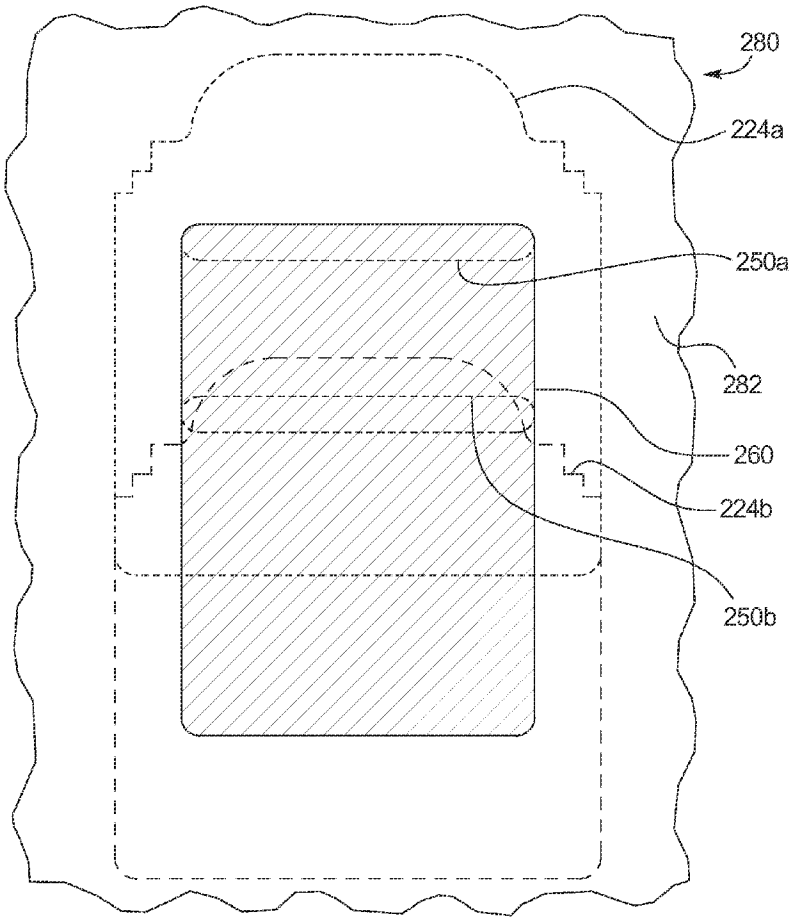
FIG. 4A is a fragmentary front view of a portion of a side frame column engaged by the friction wedge of FIG. 4, and illustrating the combined material transfer pattern or lubrication caused by the friction modifying inserts of the friction wedge of FIG. 4.

Referring now to FIGS. 4 and 4A, an alternative example embodiment of a friction wedge 200 of the present disclosure and the corresponding material transfer pattern 260 on the corresponding side frame column 280 are generally illustrated. The friction wedge 200 includes a plurality of identical friction modifying inserts 250 and 252 and identical spaced apart corresponding pockets 230 and 232 in the engagement face 224. It should be appreciated that the respective inserts and pockets do not need to be identical. In this example embodiment, like the friction modifying insert 150, each friction modifying insert 250 and 252 has an elongated oval bar shape, and each pocket 230 and 232 has a corresponding elongated oval shape, such that each pocket is configured to receive the back or rear part of the respective elongated friction modifying insert. The movement of the friction wedge 200 relative to the side frame column 280 causes certain of the material (i.e., the transfer material) from the friction modifying inserts 250 and 252 to transfer to or coat the inner surface 282 of the side frame column 280 and thus form the lubrication layer. This transfer material adheres to the inner surface 282 of the side frame column 280 generally in transfer pattern 260.

FIG. 4A illustrates in phantom the positions (indicated by numerals 250*a* and 252*a*) of the oval shapes of the friction modifying inserts when the friction wedge 200 is first installed in the railroad car truck and thus in the resting or home position relative to the side frame column 280. FIG. 4A further illustrates in phantom the range of downward movement (indicated by numerals 224*a* and 224*b*) of the engagement face 224 relative to the side frame column 280. It should be appreciated that the initial positions of the friction modifying inserts 250 and 252 and the range of movement of the engagement face 224 relative to the side frame column 280 in part determines the transfer pattern 260 and thus form the lubrication layer. In this example, the individual transfer pattern from each friction modifying insert are overlapping and form the combined transfer pattern 260.

It should be appreciated from this example that: (a) multiple friction modifying inserts of the same shape and size may be employed in accordance with the present disclosure; (b) multiple friction modifying inserts of different shapes and sizes may be employed in accordance with the present disclosure; (c) that the friction modifying inserts can be positioned to form an overlapping transfer pattern or lubrication layer; and (d) non-overlapping transfer pattern or lubrication layers.

Figure 5:
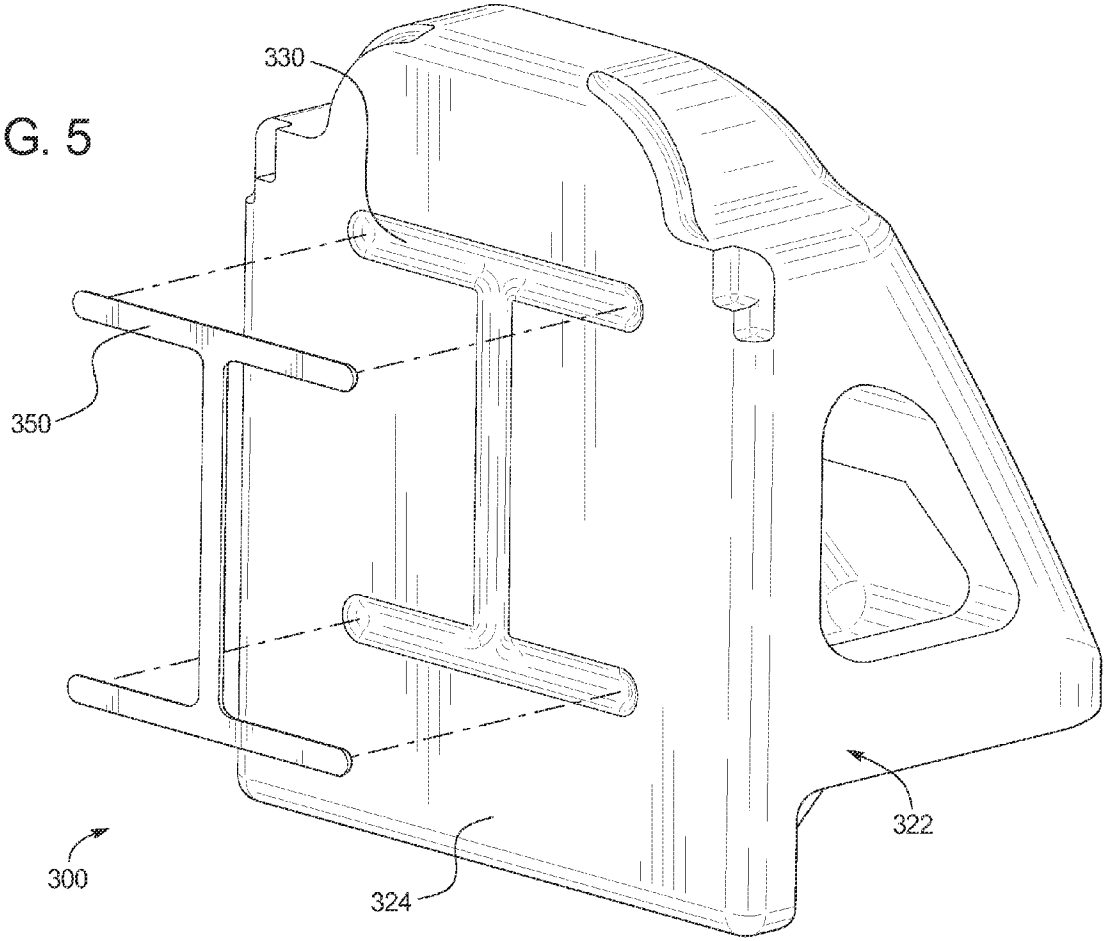
FIG. 5 is an exploded front perspective view of a railroad car friction wedge of another embodiment of the present disclosure having a capital I-shaped friction modifying insert and a corresponding pocket.
Figure 5A:
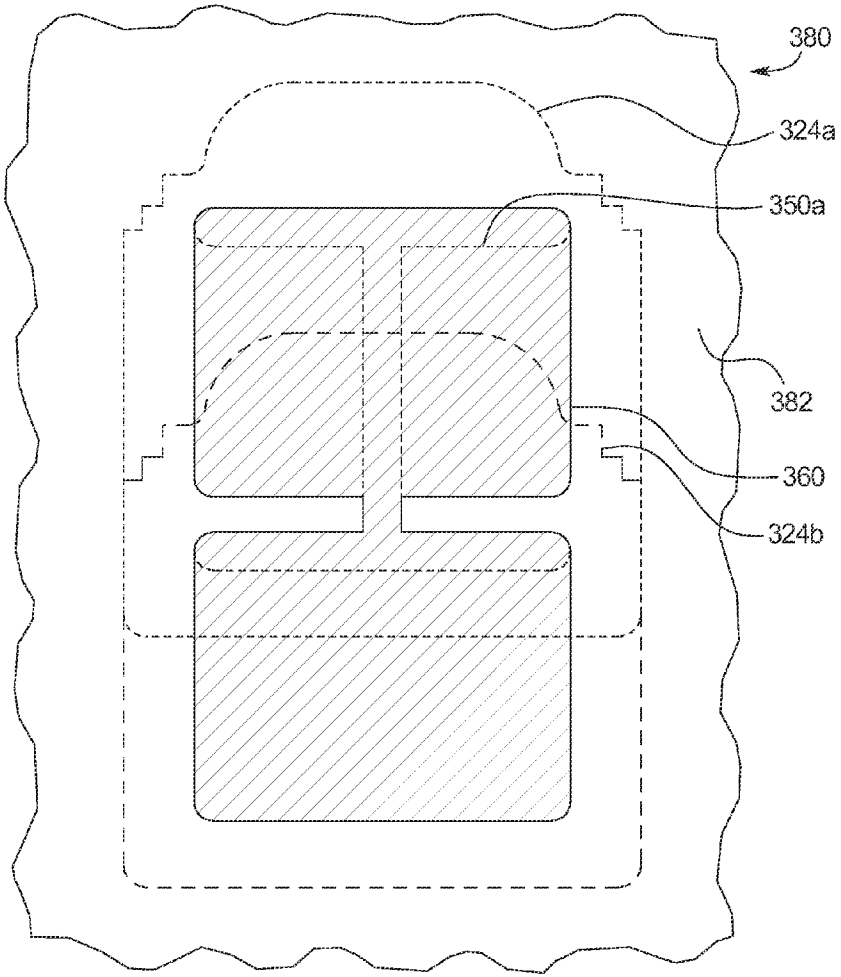
FIG. 5A is a fragmentary front view of a portion of a side frame column engaged by the friction wedge of FIG. 5, and illustrating the material transfer pattern or lubrication caused by the capital I-shaped friction modifying insert of the friction wedge of FIG. 5.

Referring now to FIGS. 5 and 5A, a further alternative example embodiment of a friction wedge 300 of the present disclosure and the corresponding material transfer pattern 360 on the corresponding side frame column 380 are generally illustrated. The friction wedge 300 includes a friction modifying insert 350 (shown in FIG. 5) and a corresponding pocket 330 (shown in FIG. 5) in the engagement face 324. In this example embodiment, the friction modifying insert 350 has a capital I-shape, and the pocket 330 has a corresponding capital I-shape, such that the pocket 330 is configured to receive the back or rear part of the friction modifying insert 350. The movement of the friction wedge 300 relative to the side frame column 380 causes certain of the material (i.e., the transfer material) from the friction modifying insert 350 to transfer to or coat the inner surface 382 of the side frame column 380 and thus form the lubrication layer. This transfer material adheres to the inner surface 382 of the side frame column 380 generally hi transfer pattern 360.

FIG. 5A illustrates in phantom the position (indicated by numeral 350*a*) of the capital I-shape friction modifying insert when the friction wedge 300 is first installed in the railroad car truck and thus in the resting or home position relative to the side frame column 380. FIG. 5A further illustrates in phantom the range of downward movement (indicated by numerals 324*a* and 324*b*) of the engagement face 324 relative to the side frame column 380. It should be appreciated that the initial position of the friction modifying insert 350 and the range of movement of the engagement face 324 relative to the side frame column in part determines the transfer pattern 360.

It should be appreciated from this example that the material transfer pattern can include interrupted sections such as between the two larger section of the transfer pattern or lubrication layers.

Figure 6:
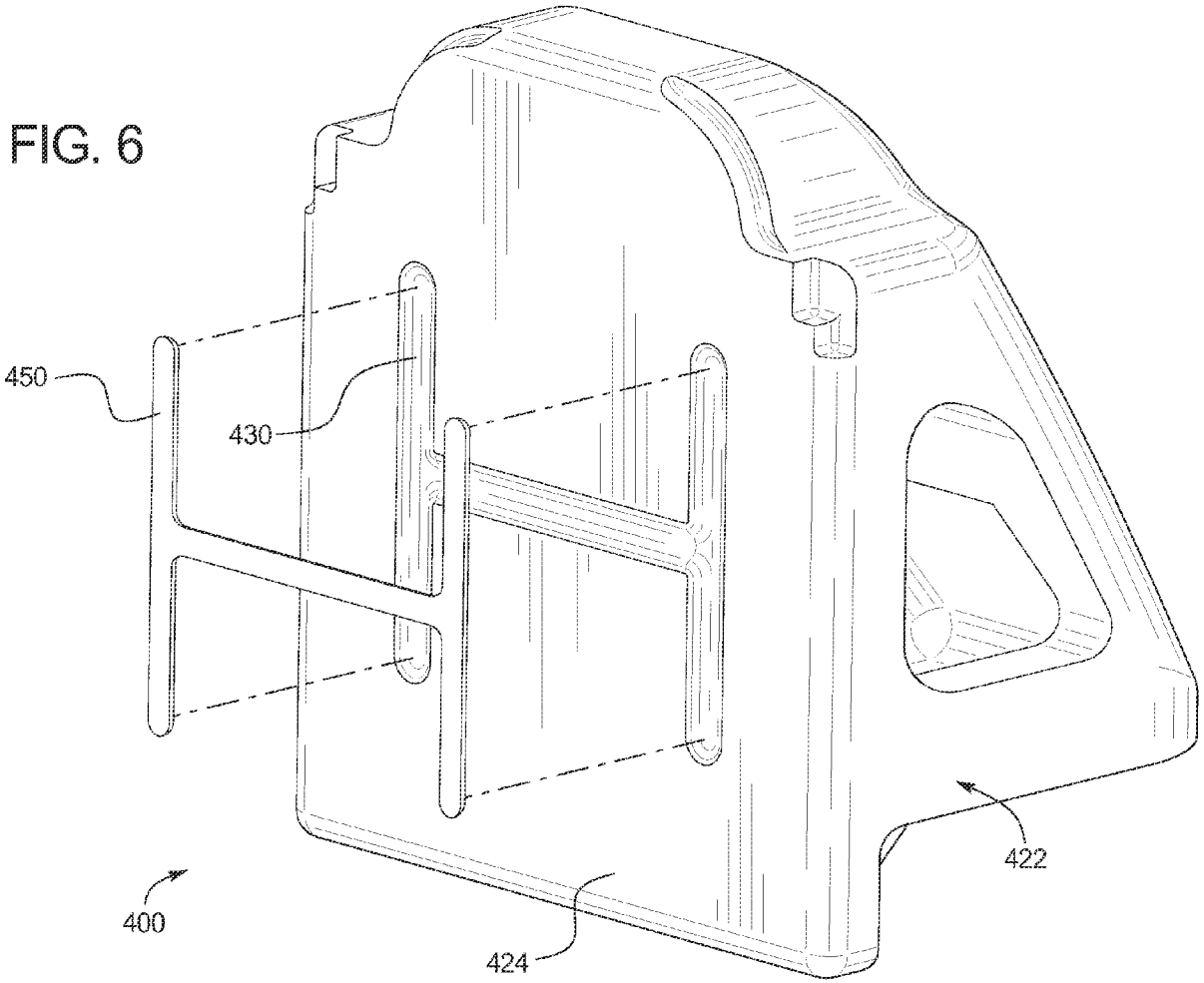
FIG. 6 is an exploded front perspective view of a railroad car friction wedge of another embodiment of the present disclosure having a capital H-shaped friction modifying insert and corresponding pocket.
Figure 6A:
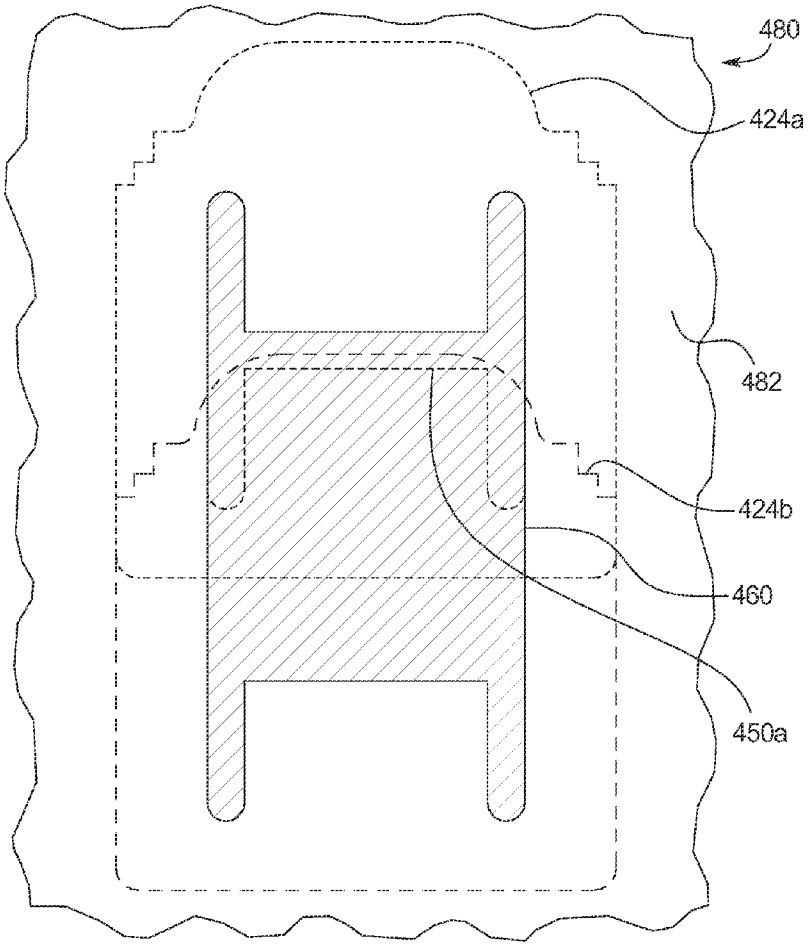
FIG. 6A is a fragmentary front view of a portion of a side frame column engaged by the friction wedge of FIG. 6, and illustrating the material transfer pattern or lubrication caused by the capital H-shaped friction modifying insert of the friction wedge of FIG. 6.

Referring now to FIGS. 6 and 6A, a further alternative example embodiment of a friction wedge 400 of the present disclosure and the corresponding material transfer pattern 460 on the corresponding side frame column 480 are generally illustrated. The friction wedge 400 includes a friction modifying insert 450 and a corresponding pocket 430 in the engagement face 424. In this example embodiment, the friction modifying insert 450 has a capital H-shape, and the pocket 430 has a corresponding capital H-shape, such that the pocket 430 is configured to receive the back or rear part of the friction modifying insert 450. The movement of the friction wedge 400 relative to the side frame column 480 causes certain of the material (i.e., the transfer material) from the friction modifying insert 450 to transfer to or coat the inner surface 482 of the side frame column 480 and thus form the lubrication layer. This transfer material adheres to the inner surface 482 of the side frame column 480 generally in transfer pattern 460.

FIG. 6A illustrates in phantom the position (indicated by numeral 450*a*) of the capital H-shape friction modifying insert when the friction wedge 400 is first installed in the railroad car truck and thus hi the resting or home position relative to the side frame column 480. FIG. 6A further illustrates in phantom the range of downward movement (indicated by numerals 424*a* and 424*b*) of the engagement face 424 relative to the side frame column 480. It should be appreciated that the initial position of the friction modifying insert 450 and the range of movement of the engagement face 424 relative to the side frame column in part determines the transfer pattern 460. It should be appreciated from this example that a relatively thin section of material may form part of the transfer pattern or lubrication layer at a horizontal portion of the H and thicker on the vertical legs of the H.

Figure 7:
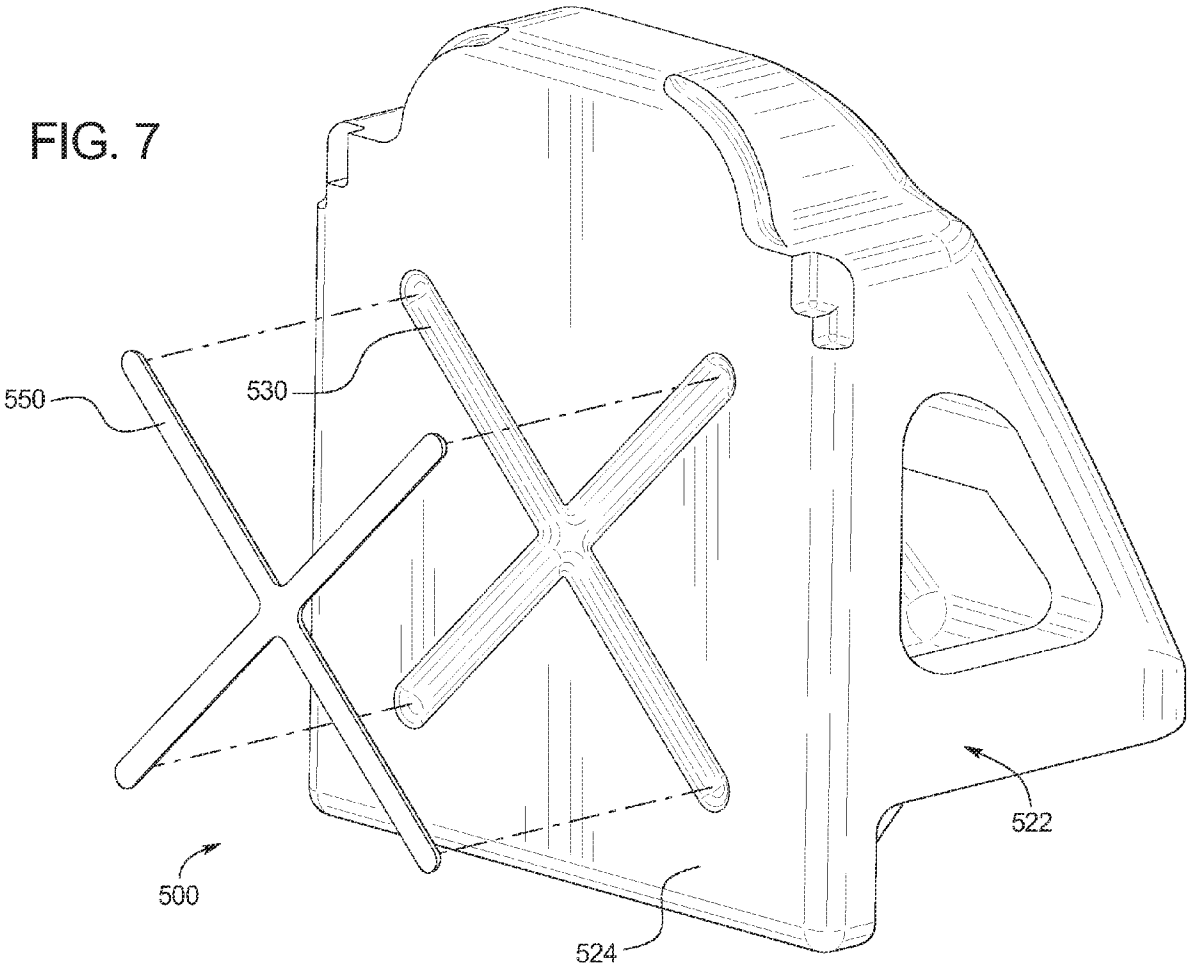
FIG. 7 is an exploded front perspective view of a railroad car friction wedge of another embodiment of the present disclosure having an X-shaped friction modifying insert and corresponding pocket.
Figure 7A:
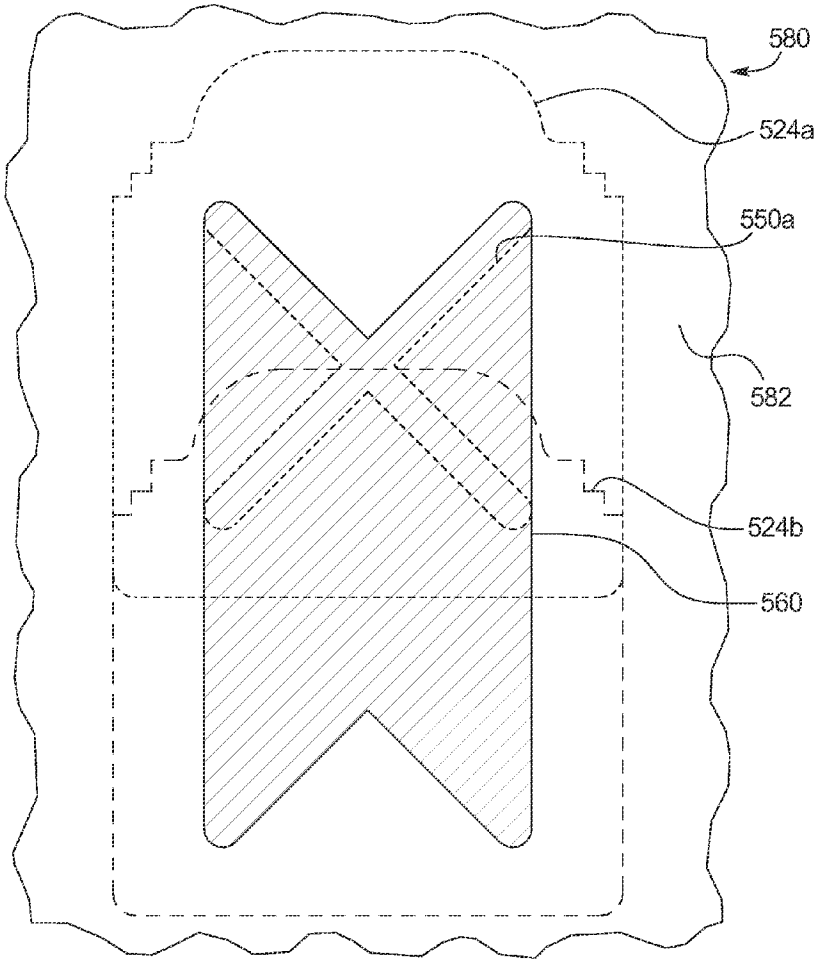
FIG. 7A is a fragmentary front view of a portion of a side frame column engaged by the friction wedge of FIG. 7, and illustrating the material transfer pattern or lubrication caused by the X-shaped friction modifying insert of the friction wedge of FIG. 7.

Referring now to FIGS. 7 and 7A, a further alternative example embodiment of a friction wedge 500 of the present disclosure and the corresponding material transfer pattern 560 on the corresponding side frame column 580 are generally illustrated. The friction wedge 500 includes a friction modifying insert 550 and a corresponding pocket 530 in the engagement face 524. In this example embodiment, the friction modifying insert 550 has an X-shape, and the pocket 530 has a corresponding X-shape, such that the pocket 530 is configured to receive the back or rear part of the respective elongated friction modifying insert 550. The movement of the friction wedge 500 relative to the side frame column 580 causes certain of the material (i.e., the transfer material) from the friction modifying insert 550 to transfer to or coat the inner surface 582 of the side frame column 580 and thus form the lubrication layer. This transfer material adheres to the inner surface 582 of the side frame column 580 generally in transfer pattern 560.

FIG. 7A illustrates in phantom the position (indicated by numeral 550*a*) of the X-shape friction modifying insert when the friction wedge 500 is first installed in the railroad car truck and thus in the resting or home position relative to the side frame column 580. FIG. 7A further illustrates in phantom the range of downward movement (indicated by numerals 524*a* and 524*b*) of the engagement face 524 relative to the side frame column 580. It should be appreciated that the initial position of the friction modifying insert 550 and the range of movement of the engagement face 524 relative to the side frame column in part determines the transfer pattern 560.

It should be appreciated from the example embodiments of FIGS. 5, 6, and 7 that: (a) the friction modifying inserts may be of substantially different shapes in accordance with the present disclosure; and (b) the friction modifying inserts allow metal to metal contact between the components while controlling the desired amount of lubrication between the engaging components and thus controlling the amount of friction between the components.

Figure 8:
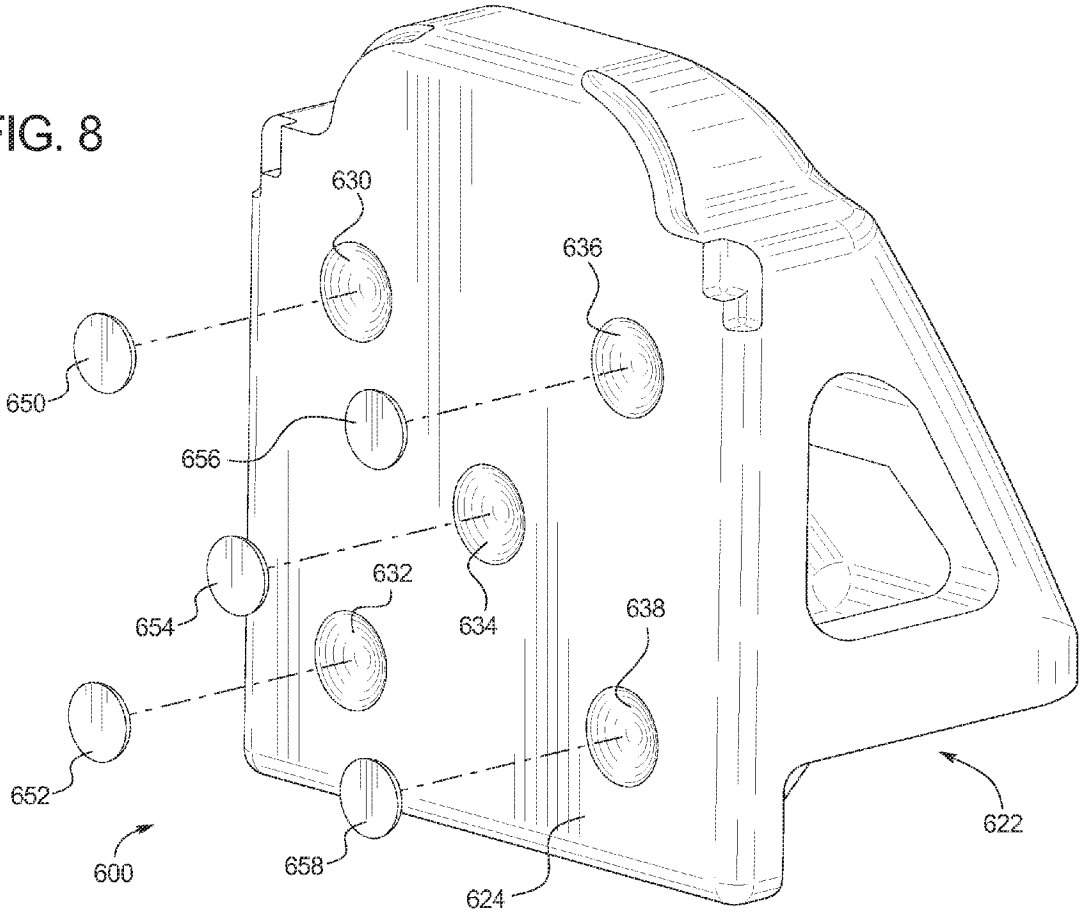
FIG. 8 is an exploded front perspective view of a railroad car friction wedge of another embodiment of the present disclosure having a plurality of spaced apart cylindrical friction modifying inserts and corresponding pockets.
Figure 8A:
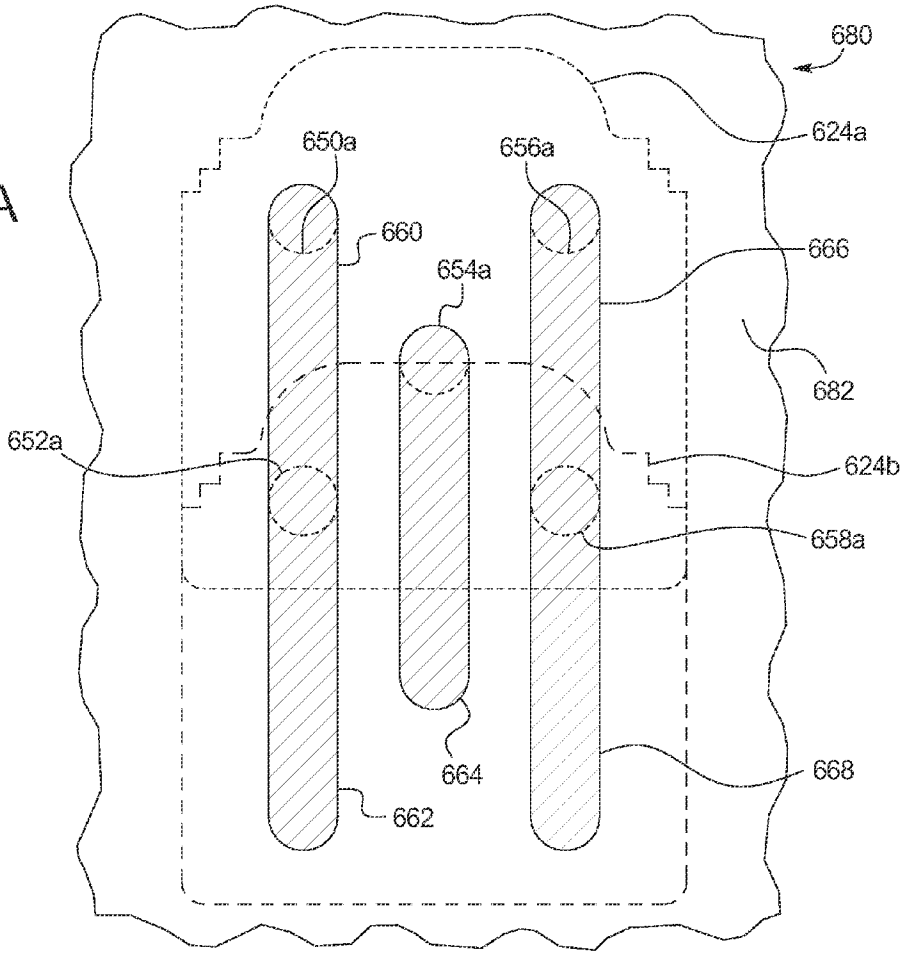
FIG. 8A is a fragmentary front view of a portion of a side frame column engaged by the friction wedge of FIG. 8, and illustrating the material transfer patterns or lubrication caused by the plurality of cylindrical friction modifying inserts of the friction wedge of FIG. 8.

Referring now to FIGS. 8 and 8A, a further alternative example embodiment of a friction wedge 600 of the present disclosure and the corresponding material transfer patterns or lubrication layers on the corresponding side frame column 680 are generally illustrated. The friction wedge 600 includes a plurality of friction modifying inserts 650, 652, 654, 656, and 658 and corresponding pockets 630, 632, 634, 636, and 638 in the engagement face 624. In this example embodiment, each friction modifying insert has a generally cylindrical shape, and each pocket has a corresponding generally cylindrical shape, such that each pocket is configured to receive the back or rear part of the respective friction modifying insert. The movement of the friction wedge 600 relative to the side frame column 680 causes certain of the material (i.e., the transfer material) from each of the friction modifying inserts 650, 652, 654, 656, and 658 to transfer to or coat the inner surface 682 of the side frame column 680. This transfer material adheres to the inner surface 682 of the side frame column 680 generally in individual transfer patterns 660, 662, 664, 666, and 668 and thus the lubrication layers. In this embodiment, transfer patterns 660 and 662 overlap, transfer patterns 666 and 668 overlap, and transfer pattern 664 does not overlap with any of the other transfer patterns.

FIG. 8A illustrates in phantom the positions (indicated by numerals 650*a*, 652*a*, 654*a*, 656*a*, and 658*a*) of the cylindrical shape of each of the friction modifying inserts when the friction wedge 600 is first installed in the railroad car truck, and thus in the resting or home position relative to the side frame column 680. FIG. 8A further illustrates in phantom the range of downward movement (indicated by numerals 624*a* and 624*b*) of the engagement face 624 relative to the side frame column 680. It should be appreciated that the initial position of the friction modifying inserts 650, 652, 654, 656, and 658 and the range of movement of the engagement face 624 relative to the side frame column 680 in part determine the respective transfer patterns 660, 662, 664, 666, and 668.

It should be appreciated from this example that; (a) the shape of the friction modifying inserts may vary in accordance with the present disclosure; (b) that individual and overlapping transfer patterns may be simultaneously employed; and (c) the friction modifying inserts thereby provide the desired amount of friction.

Figure 9:
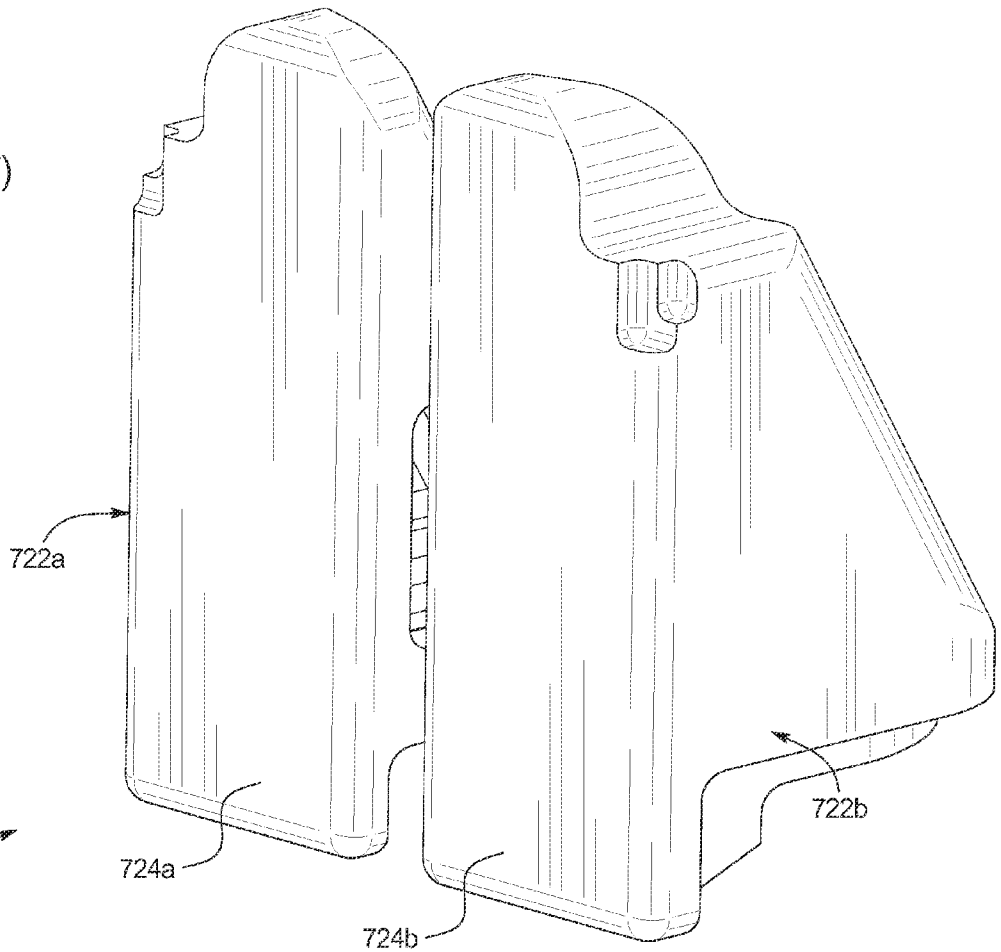
FIG. 9 (PRIOR ART)
FIG. 9 is a front perspective view of a known or prior art split body railroad car friction wedge.
Figure 10:
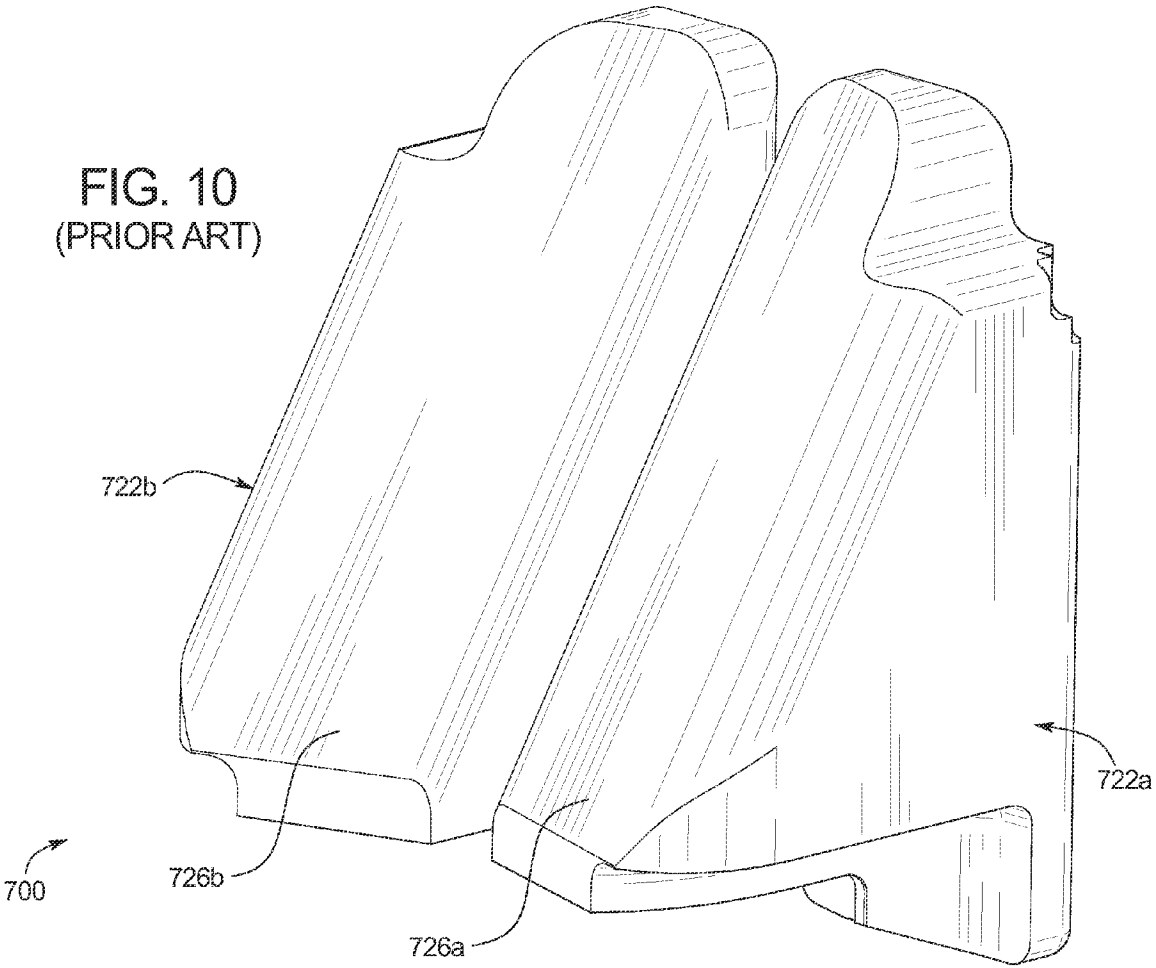
FIG. 10 (PRIOR ART)
FIG. 10 is a rear perspective view of the known or prior art split body railroad car friction wedge of FIG. 9.

Referring now to FIGS. 9 and 10, a known split body friction wedge is generally illustrated and indicated by numeral 700. This split body friction wedge is another example of a railroad car high friction component. This friction wedge 700 includes two bodies 722*a* and 722*b*, engagement faces 724*a* and 724*b* on one side of the bodies 722*a* and 722*b*, and sloped surfaces 726*a* and 726*b* on the other side of the bodies 722*a* and 722*b*. The engagement faces 724*a* and 724*b* are high friction surfaces because they are configured to engage the inner surface of a side frame column of a truck of a freight railroad car. While the engagement faces 724*a* and 724*b* are used herein as another example of high friction surfaces of the present disclosure, it should be appreciated that the present disclosure is not limited to this type split body friction wedge.

Figure 11:
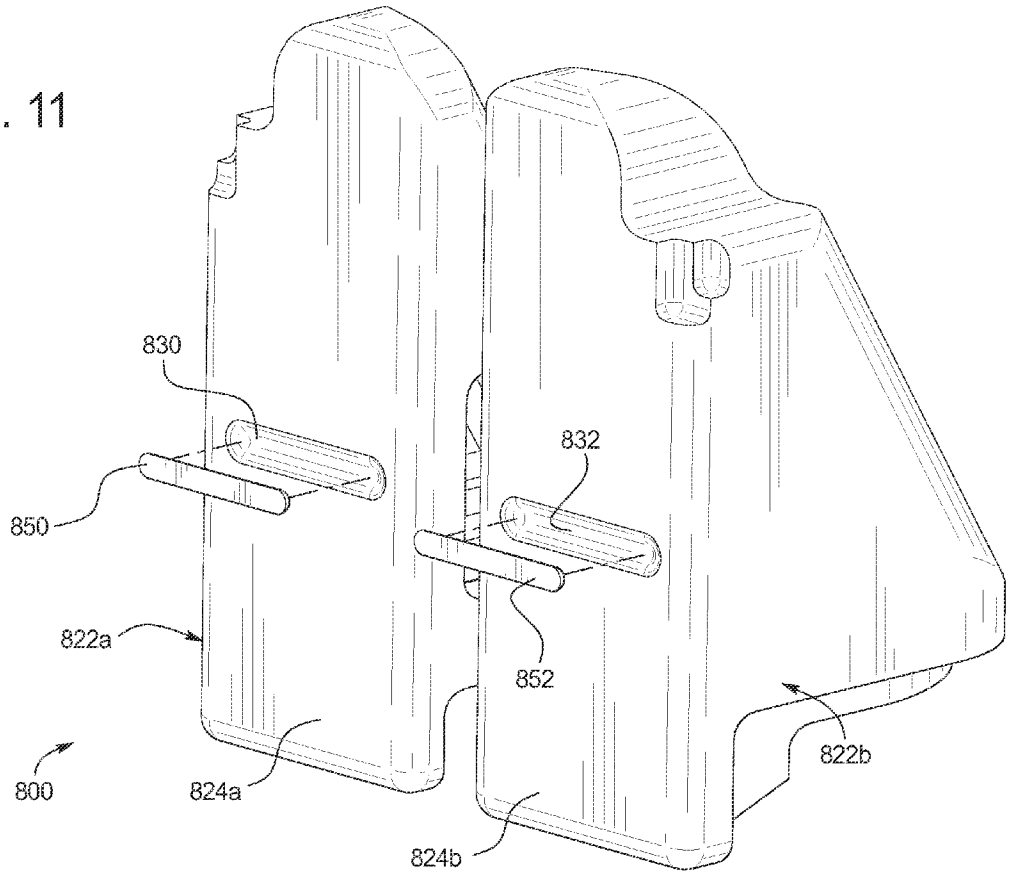
FIG. 11 is an exploded front perspective view of a split body railroad car friction wedge of one embodiment of the present disclosure having two elongated bar shaped friction modifying inserts, one on each of the split bodies, and corresponding pockets.

Referring now to FIG. 11, one example embodiment of a split body friction wedge 800 of the type shown in FIGS. 9 and 10 is generally illustrated. The friction wedge 800 includes a plurality of friction modifying inserts 850 and 852 and respective corresponding pockets 830 and 832 in the engagement faces 824*a* and 824*b*. In this example embodiment, each friction modifying insert 850 and 852 has an elongated oval bar shape, and each pocket 830 and 832 has a corresponding elongated oval shape, such that each pocket is configured to receive the back or rear part of the respective elongated friction modifying insert. The movement of the friction wedge 800 relative to the corresponding side frame column (not shown) causes certain of the material (i.e., the transfer material) from the friction modifying inserts 850 and 852 to transfer to or coat the inner surface of the corresponding side frame column (not shown). This transfer material adheres to the inner surface of the corresponding side frame column (not shown) generally in a plurality of transfer patterns (not shown) in the same manner as described above and forms lubrication layers in the same manner as described above.

Figure 12:
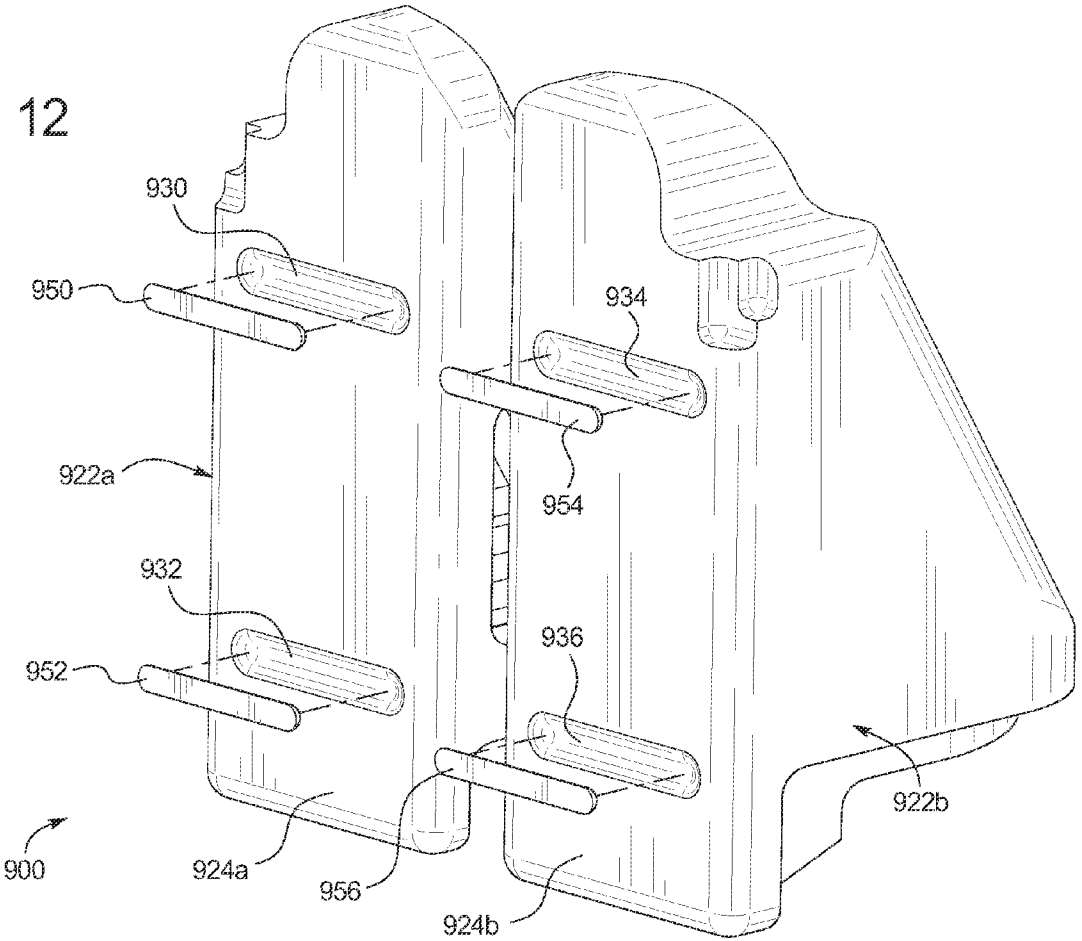
FIG. 12 is an exploded front perspective view of a split body railroad car friction wedge of another embodiment of the present disclosure having four elongated bar shaped friction modifying inserts, two on each of the split bodies, and corresponding pockets.

Referring now to FIG. 12, another example embodiment of a split body friction wedge 900 of the type shown in FIGS. 9 and 10 is generally illustrated. The friction wedge 900 includes a plurality of friction modifying inserts 950, 952, 954, and 956 and corresponding pockets 930, 932, 934, and 936 respectively in the engagement faces 924*a* and 924*b*. In this example embodiment, each friction modifying insert 950, 952, 954, and 956 has an elongated oval bar shape, and each pocket 930, 932, 934, and 936 has a corresponding elongated oval shape, such that each pocket is configured to receive the back or rear part of the respective elongated friction modifying insert. The movement of the friction wedge 900 relative to the side frame column (not shown) causes certain of the material the transfer material) from the friction modifying inserts 950, 952, 954, and 956 to transfer to or coat the inner surface of the side frame column (not shown). This transfer material adheres to the inner surface of the corresponding side frame column (not shown) generally in a plurality of transfer patterns (not shown) in the manner described above and form lubrication layers in the same manner as described above.

Figure 13:
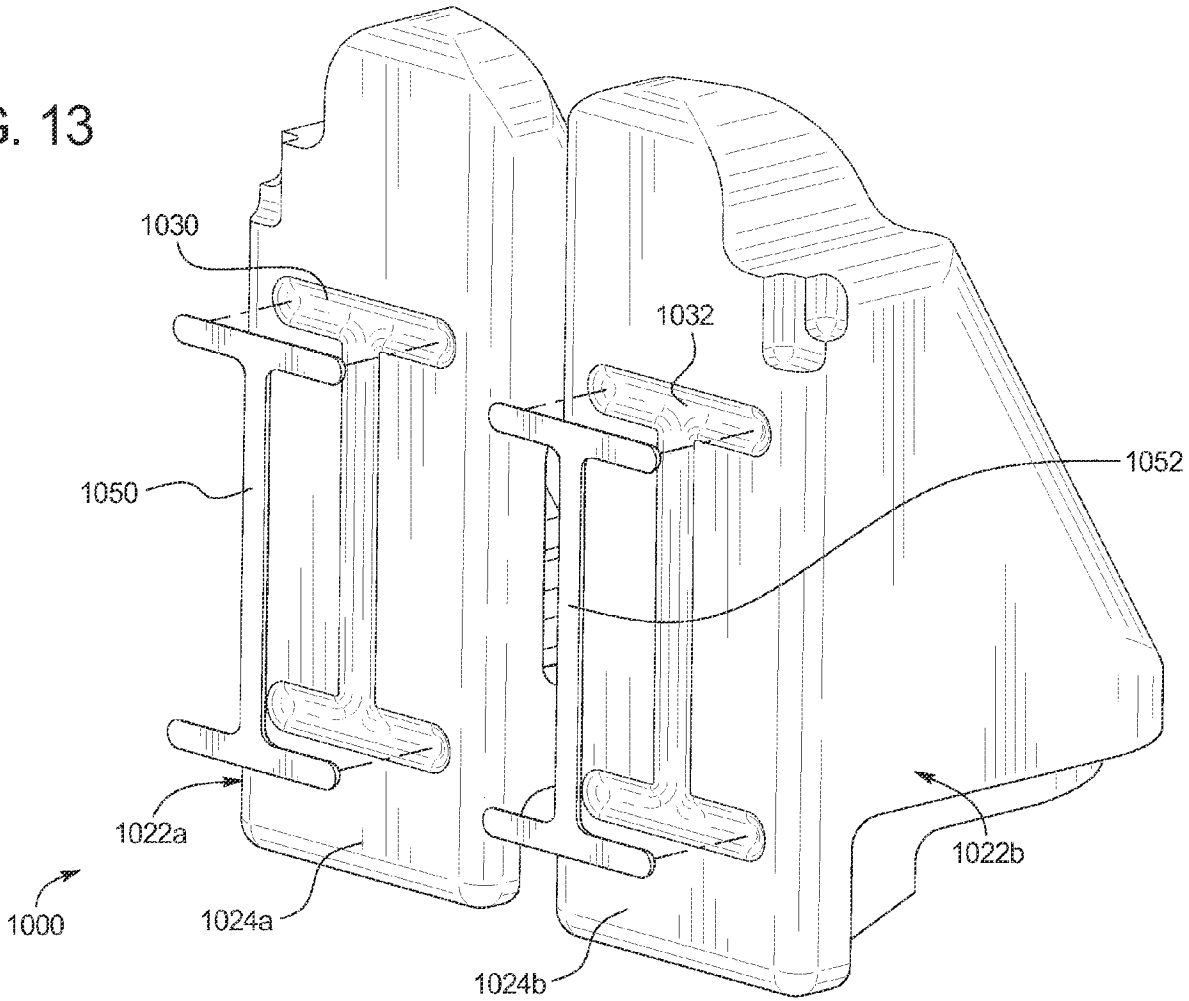
FIG. 13 is an exploded front perspective view of a split body railroad car friction wedge of another embodiment of the present disclosure having two capital I-shaped friction modifying inserts, one on each of the split bodies, and corresponding pockets.

Referring now to FIG. 13, another example embodiment of a split body friction wedge 1000 of the type shown in FIGS. 9 and 10 is generally illustrated. The friction wedge 1000 includes a plurality of friction modifying inserts 1050 and 1052 and corresponding pockets 1030 and 1032 in the engagement faces 1024*a* and 1024*b*. In this example embodiment, each friction modifying insert 1050 and 1052 has a capital I-shape, and each pocket 1030 and 1032 has a corresponding capital I-shape, such that each pocket is configured to receive the back or rear part of the respective friction modifying insert. The movement of the friction wedge 1000 relative to the side frame column (not shown) causes certain of the material (i.e., the transfer material) from the friction modifying inserts 1050 and 1052 to transfer to or coat the inner surface of the corresponding side frame column (not shown). This transfer material adheres to the inner surface of the corresponding side frame column (not shown) generally in a plurality of transfer patterns (not shown) in the same manner as described above and form lubrication layers in the same manner as described above.

Figure 14:
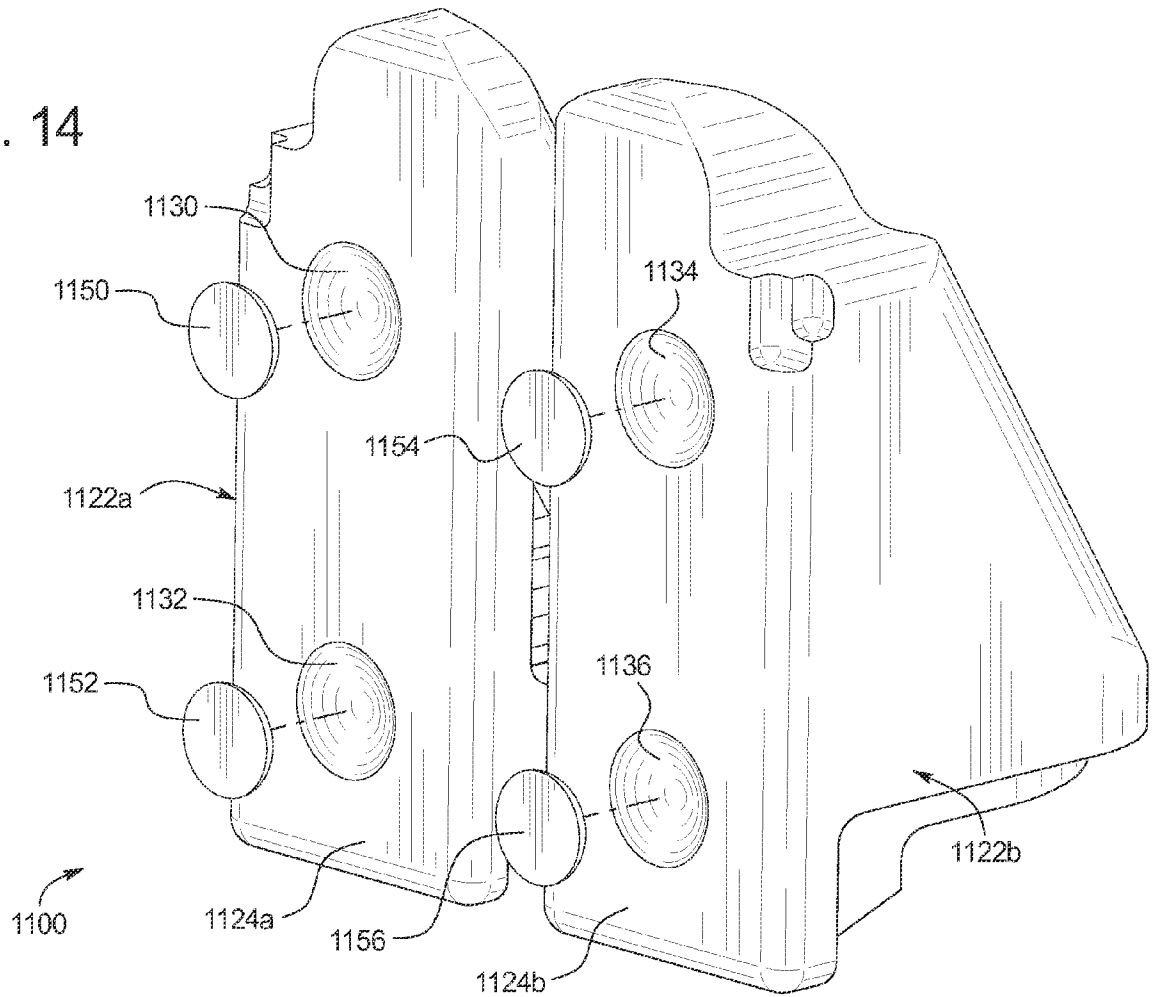
FIG. 14 is an exploded front perspective view of a split body railroad car friction wedge of another embodiment of the present disclosure having four cylindrical friction modifying inserts, two on each of the split bodies, and corresponding pockets.

Referring now to FIG. 14, another example embodiment of a split body friction wedge 1100 of the type shown in FIGS. 9 and 10 is generally illustrated. The friction wedge 1100 includes a plurality of friction modifying inserts 1150, 1152, 1154, and 1156 and corresponding pockets 1130, 1132, 1134, and 1136 respectively in the engagement faces 1124*a* and 1124*b*. In this example embodiment, each friction modifying inserts 1150, 1152, 1154, and 1156 each has a cylindrical shape, and each pocket 1130, 1132, 1134, and 1136 also each has a corresponding cylindrical shape, such that each pocket is configured to receive the back or rear part of the respective elongated friction modifying insert. The movement of the friction wedge 1100 relative to the side frame column (not shown) causes certain of the material (i.e., the transfer material) from the friction modifying inserts 1150, 1152, 1154, and 1156 to transfer to or coat the inner surface of the side frame column. This transfer material adheres to the inner surface of the corresponding side frame column (not shown) generally in a plurality of transfer patterns (not shown) in the manner described above and form lubrication layers in the same manner as described above.

Figure 15:
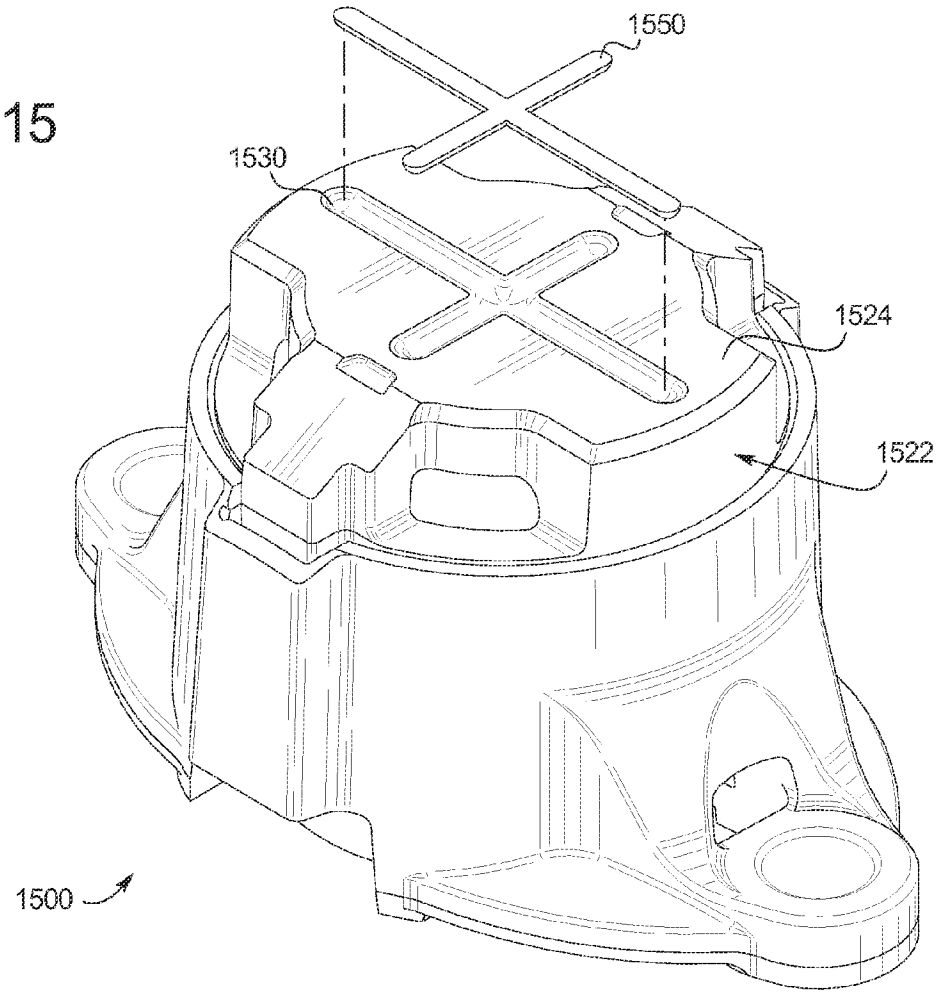
FIG. 15 is an exploded top perspective view of a railroad car constant contact side bearing of another embodiment of the present disclosure having a t-shape or cross shaped friction modifying insert and corresponding pocket.
Figure 16:
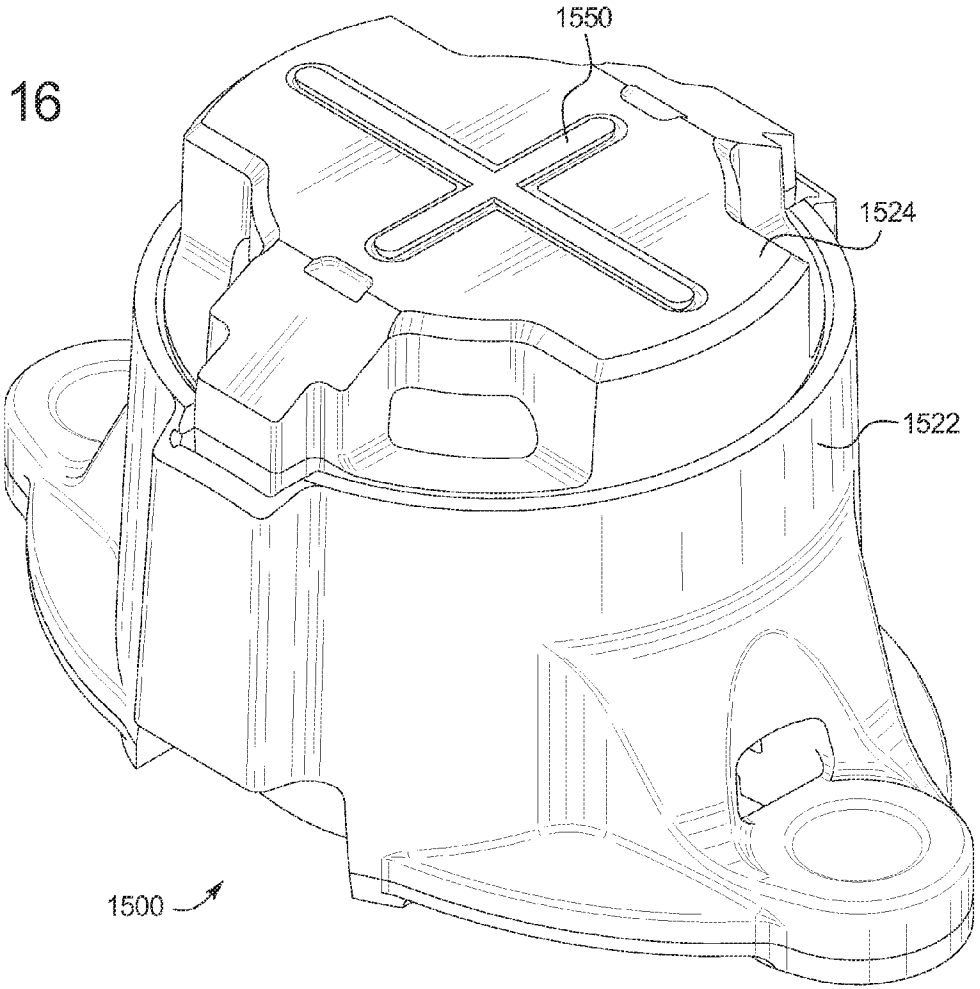
FIG. 16 is a top perspective view of the railroad car constant contact side bearing of FIG. 15 with the t-shape or cross shaped friction modifying insert mounted in the pocket in the engagement surface.
Figure 16A:
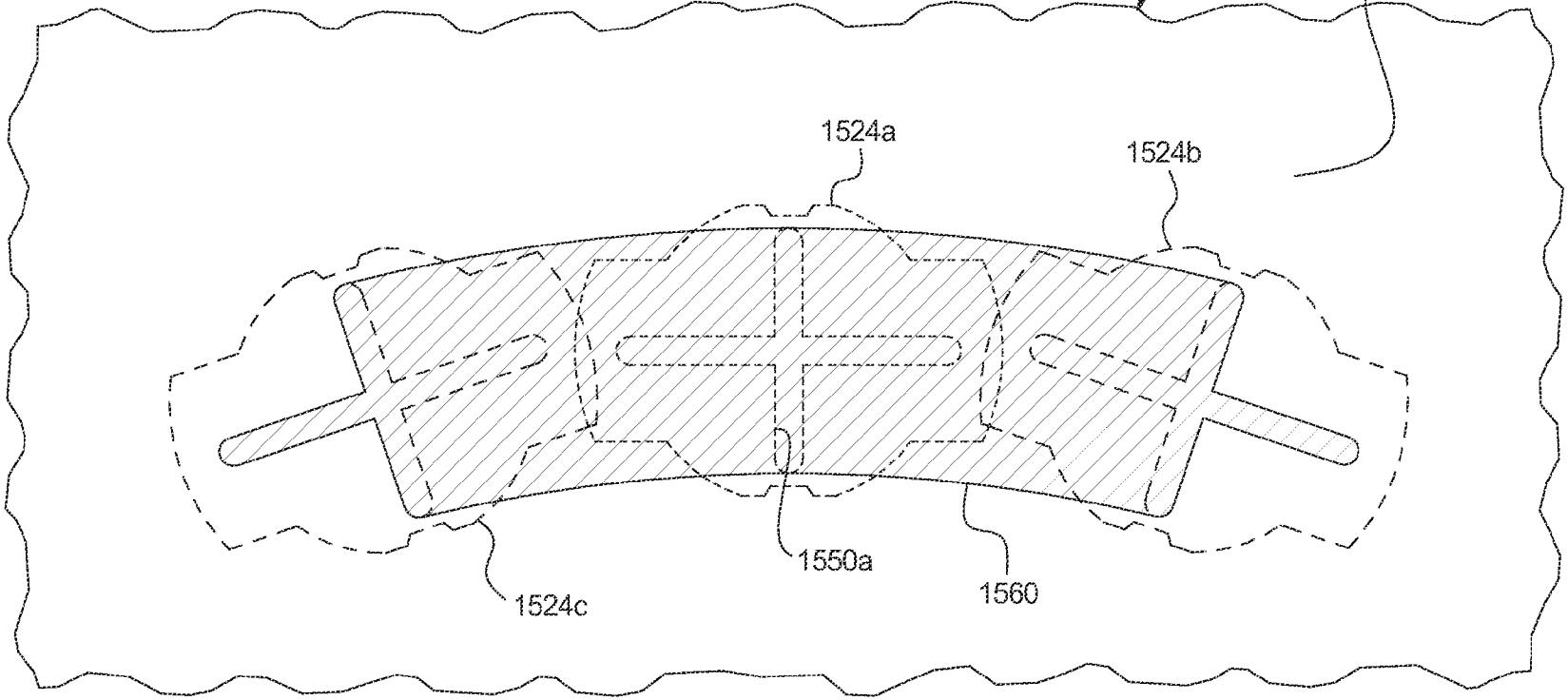
FIG. 16A is a fragmentary bottom view of the underside of the railroad car body, and illustrating the material transfer pattern or lubrication caused by the t-shape or cross shaped friction modifying insert of the constant contact side bearing of FIGS. 15 and 16.

Referring now to FIGS. 15, 16, and 16A, another example embodiment of the present disclosure is shown in connection with a railroad car constant contact side bearing 1500. This constant contact side bearing is another example of a railroad car high friction component. This side bearing 1500 includes a body 1522 and an engagement face 1524 on the top of the body 1522. The engagement face 1524 is a high friction surface because it is configured to engage the underside of the railroad car body or a wear plate thereon. The underside of the railroad car body or a wear plate thereon is sometimes referred to herein as the underbody for brevity. While the engagement face 1524 is used herein as another example of a high friction surface of the present disclosure, it should be appreciated that the present disclosure is not limited to this constant contact side bearing.

This constant contact side bearing 1500 includes a friction modifying insert 1550 and a corresponding pocket 1530 in the engagement face 1524. In this example embodiment, the friction modifying insert 1550 has a t-shape or cross shape, and the pocket 1530 has a corresponding t-shape or cross shape, such that the pocket 1530 is configured to receive the back or rear part of the friction modifying insert 1550. The pivotal movement of the car body relative to the truck (not shown) and the side bearing 1500 on the truck causes certain of the material (i.e., the transfer material) from the friction modifying insert 1550 to transfer to or coat the surface of the underbody and thus forms the lubrication layer.

The material transfer pattern 1560 on the surface 1582 of the underbody 1580 caused by the constant contact side bearing 1500 is generally illustrated in FIG. 16A. More particularly, after installation, when the constant contact side bearing 1500 with the friction modifying insert 1550 is initially positioned in its working position in the railroad car, the friction modifying insert 1550 is disposed between the engagement face 1524 of the constant contact side bearing 1500 (i.e., the high friction component) and the corresponding engagement surface of the underbody. When the truck moves or pivots in a somewhat arc shaped direction relative to the car body, this pivotal movement causes certain of the material (i.e., the transfer material) from the friction modifying insert 1550 to transfer to the inner surface 1582 of the underbody 1580, and more particularly to be spread over or to coat a portion of the engagement surface 1582 of the underbody 1580. This transferred material adheres to the surface 1582 of the underbody 1580 generally in transfer pattern 1560 based on this movement the car body relative to the side bearing 1500 and based on the shape and size of the friction modifying insert 1550. This transferred material forms a relatively thin lubrication layer between the constant contact side bearing and the underbody which has the shape of the transfer pattern 1560 to more closely control or provide the optimal amount of resistance or friction between the truck and the car body without preventing substantial engagement between these components.

More specifically, FIG. 16A illustrates in phantom the relative position (indicated by numeral 1550*a*) of the t-shape or cross shape of the friction modifying insert 1550 when the friction wedge 1500 is first installed in the railroad car truck and thus in the resting or home position relative to the underbody. FIG. 16A further illustrates in phantom the range of movement (indicated by numerals 1524*a*, 1524*b*, and 1524*c*) of the car body relative to the engagement face 1524. It should be appreciated that the initial position of the friction modifying insert 1550 and the range of movement of the car body relative to the constant contact side bearing 1500 in part determine the overall transfer pattern 1560. It should be appreciated that as the transfer pattern is formed on the underbody, the portion of the friction modifying insert that initially protrudes from the pocket is reduced (i.e., because the transfer material is transferred to the opposing surface).

Figure 17:
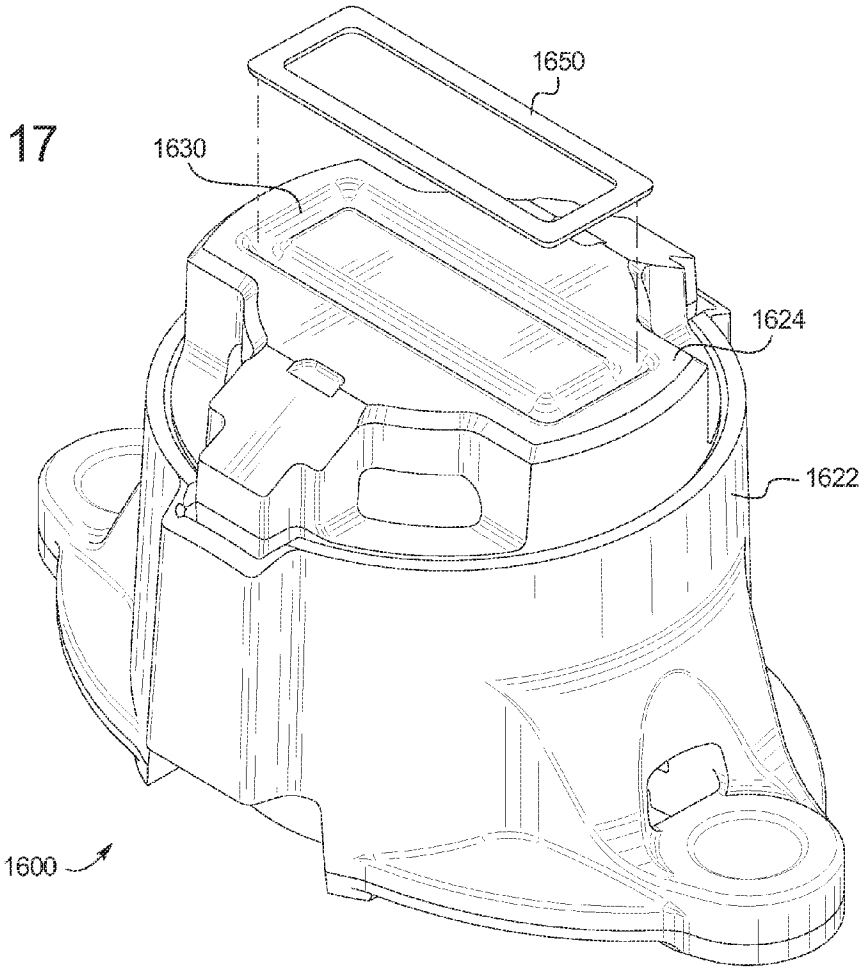
FIG. 17 is an exploded top perspective view of a railroad car constant contact side bearing of another embodiment of the present disclosure having a generally rectangular friction modifying insert and corresponding pocket.
Figure 18:
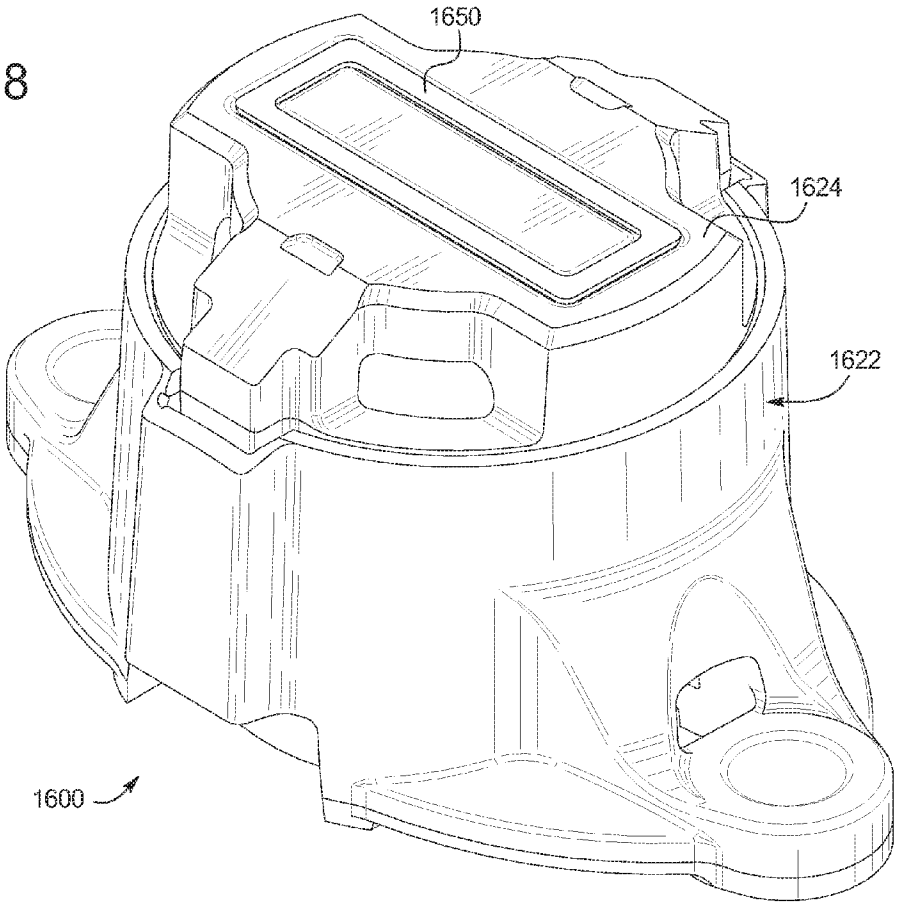
FIG. 18 is a top perspective view of the railroad car constant contact side bearing of FIG. 17 with the generally rectangular friction modifying insert mounted in the pocket in the engagement surface.
Figure 18A:
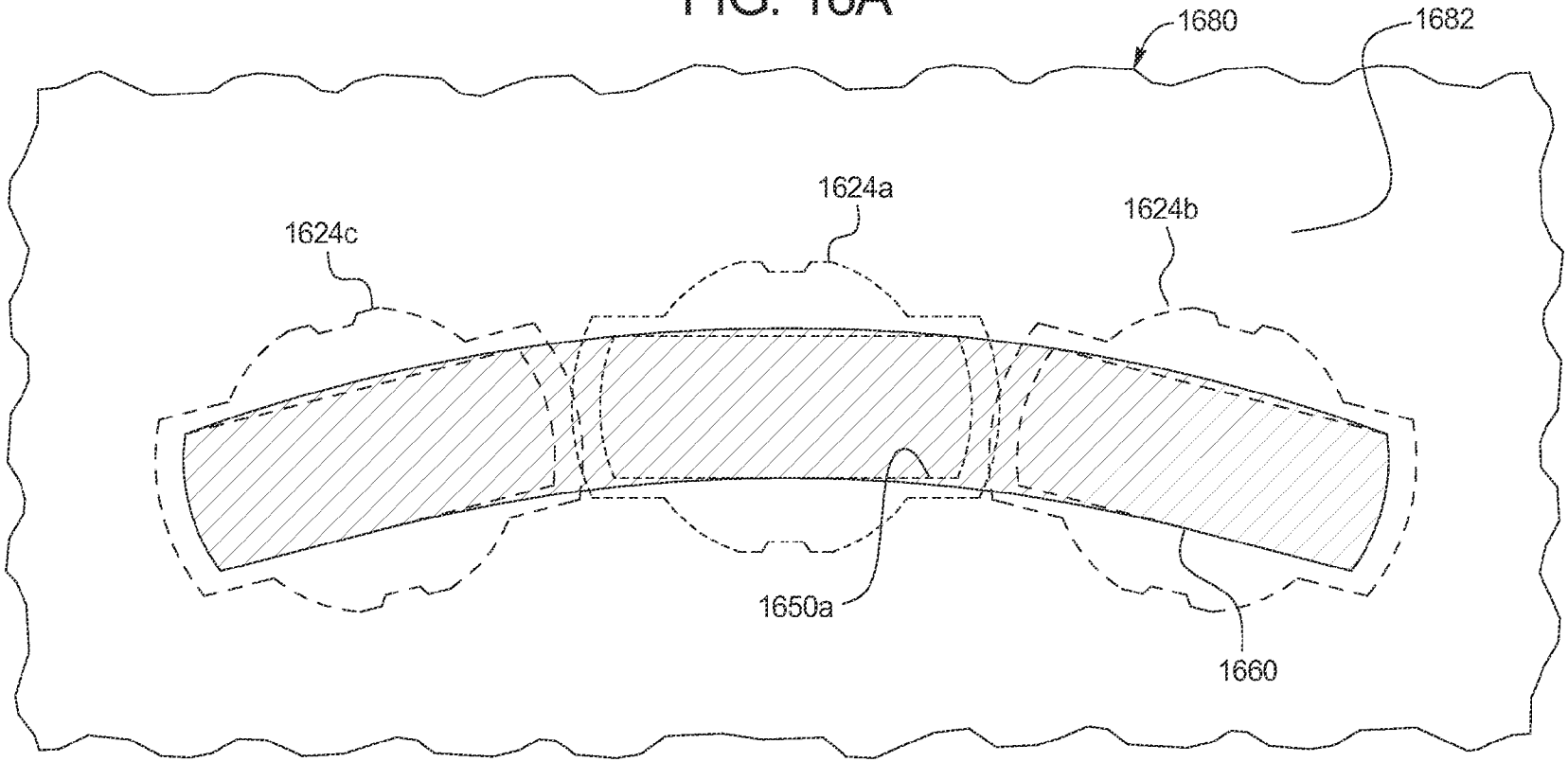
FIG. 18A is a fragmentary bottom view of the underside of the railroad car body, and illustrating the material transfer pattern or lubrication caused by the rectangular friction modifying insert of the constant contact side bearing of FIGS. 17 and 18.

Referring now to FIGS. 17, 18, and 18A, another example embodiment of the present disclosure is shown in connection with a railroad car constant contact side bearing 1600. This side bearing 1600 includes a body 1622 and an engagement face 1624 on the top of the body 1622. The constant contact side bearing 1600 includes a friction modifying insert 1650 and a corresponding pocket 1630 in the engagement face 1624. In this example embodiment, the friction modifying insert 1650 has an generally rectangular shape, and the pocket 1630 has a corresponding generally rectangular shape, such that the pocket 1630 is configured to receive the back or rear part of the friction modifying insert 1650. The movement of the car body relative to the constant contact side bearing 1600 causes certain of the material (i.e., the transfer material) from the friction modifying insert 1650 to transfer to or coat the inner surface 1682 of the underbody 1680 to form the transfer pattern 1660 and thus form the lubrication layer. FIG. 18A illustrates in phantom the relative position (indicated by numeral 1650*a*) of rectangular shaped friction modifying insert when the side bearing 1600 is first installed in the railroad car truck and thus in the resting or home position relative to the car underbody (or wear plate thereon). FIG. 18A further illustrates in phantom the range of movement (indicated by numerals 1624*a*, 1624*b*, and 1624*c*) of the car body relative to the engagement face 1624.

Figure 19:
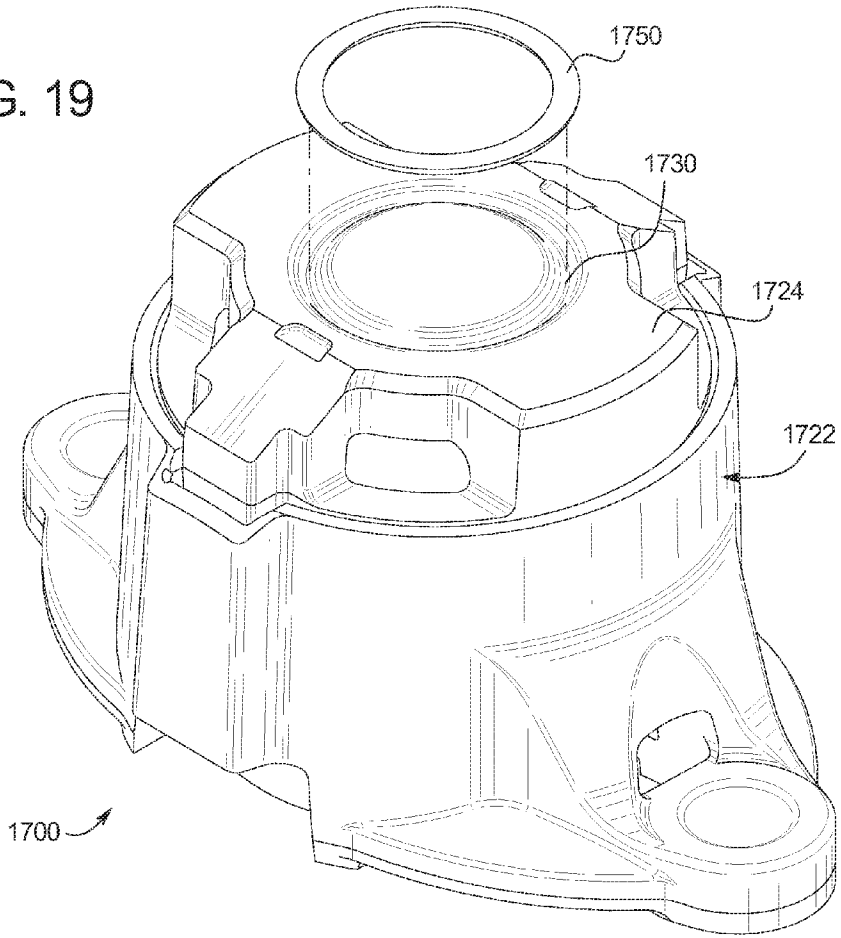
FIG. 19 is an exploded top perspective view of a railroad car constant contact side bearing of another embodiment of the present disclosure having a circular friction modifying insert and corresponding pocket.
Figure 20:
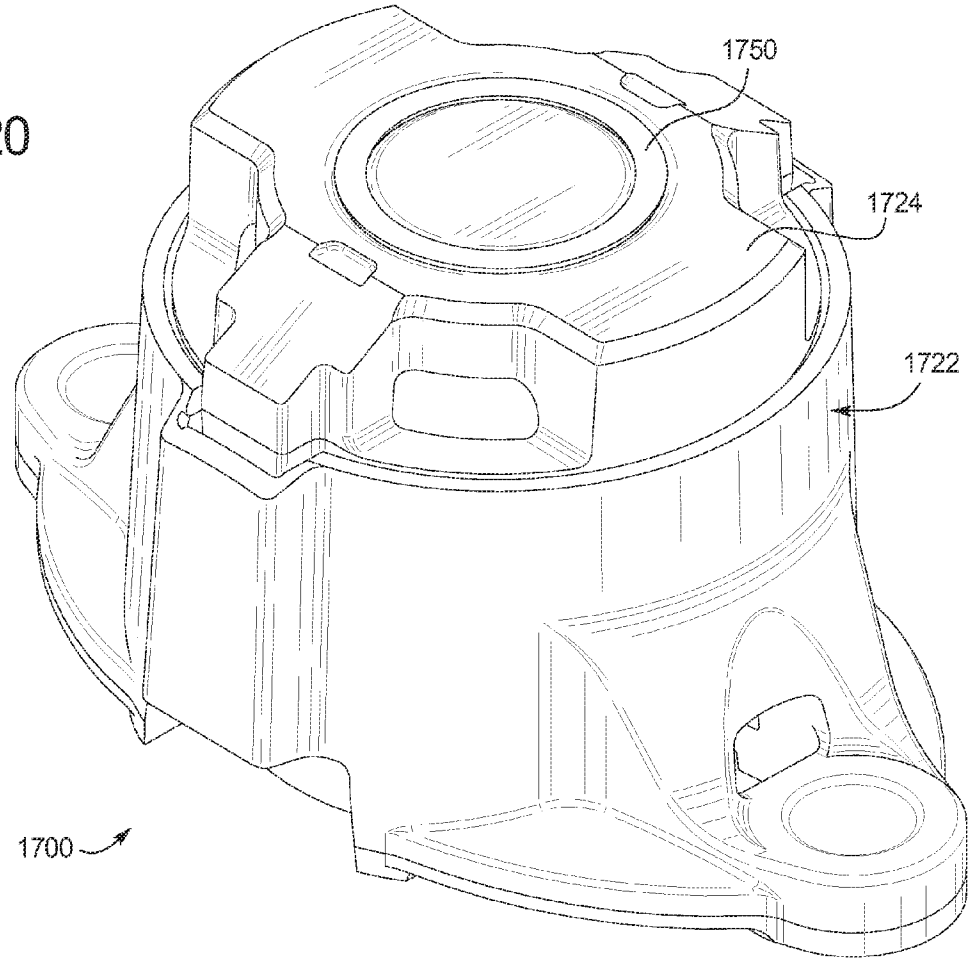
FIG. 20 is a top perspective view of the railroad car constant contact side bearing of FIG. 19 with the circular friction modifying insert mounted in the pocket in the engagement surface.
Figure 20A:
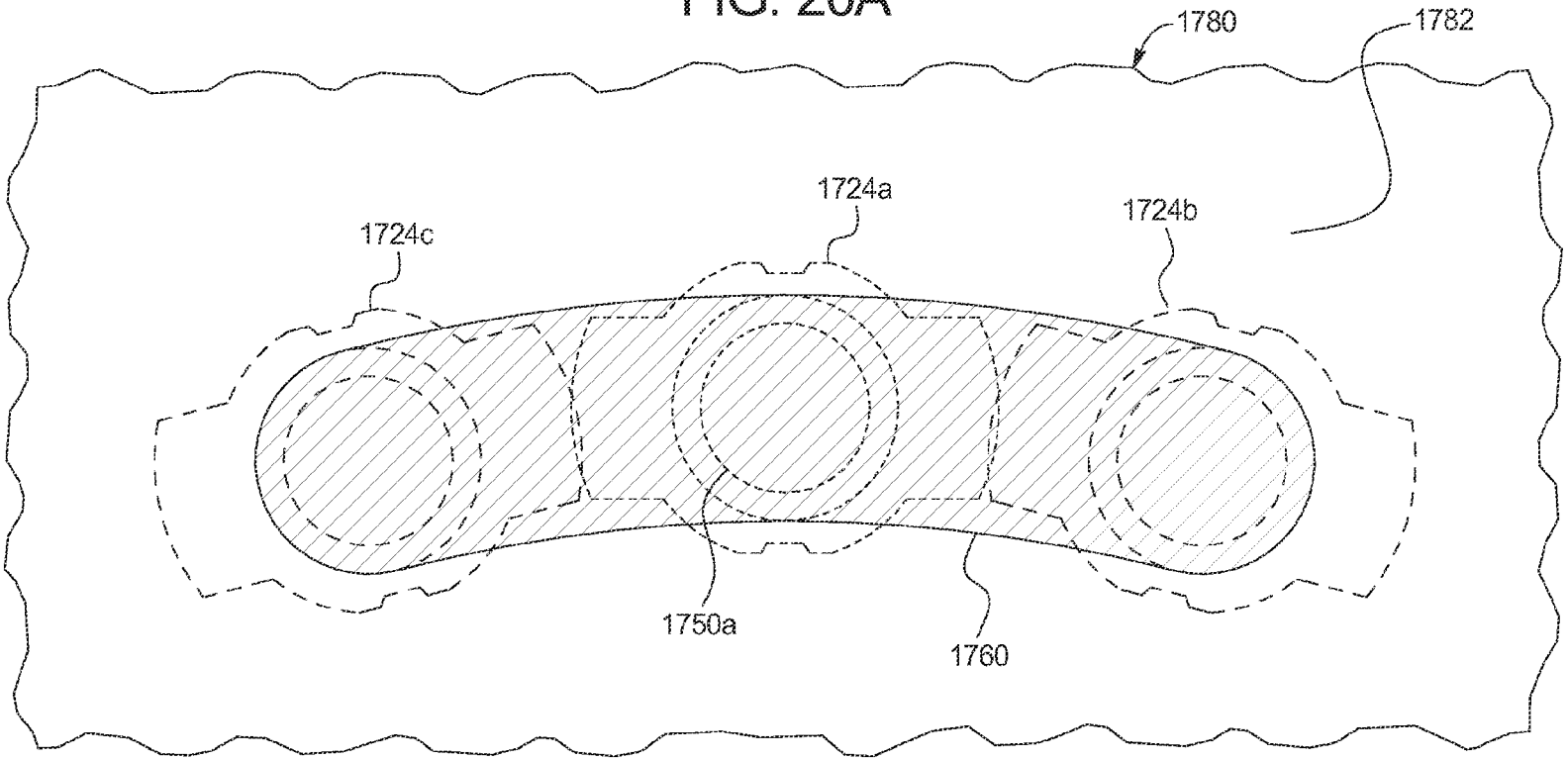
FIG. 20A is a fragmentary bottom view of the underside of the railroad car body, and illustrating the material transfer pattern or lubrication caused by the circular friction modifying insert of the constant contact side bearing of FIGS. 19 and 20.

Referring now to FIGS. 19, 20, and 20A, another example embodiment of the present disclosure is shown in connection with a railroad car constant contact side bearing 1700. This constant contact side bearing 1700 includes a body 1722 and an engagement face 1724 on the top of the body 1722. The constant contact side bearing 1700 includes a friction modifying insert 1750 and a corresponding pocket 1730 in the engagement face 1724. In this example embodiment, the friction modifying insert 1750 has an generally circular shape, and the pocket 1730 has a corresponding generally circular shape, such that the pocket 1730 is configured to receive the back or rear part of the friction modifying insert 1750. The movement of the car body relative to the constant contact side bearing 1700 causes certain of the material (i.e., the transfer material) from the friction modifying insert 1750 to transfer to or coat the inner surface of the underbody and thus form the lubrication layer. FIG. 20A illustrates in phantom the relative position (indicated by numeral 1750*a*) of the circular shape of the friction modifying insert 1750 when the constant contact side bearing 1700 is first installed in the railroad car truck and thus in the resting or home position relative to the car body. FIG. 20A further illustrates in phantom the range of movement (indicated by numerals 1724*a*, 1724*b*, and 1724*c*) of the car body relative to the engagement face 1724.

Figure 21:
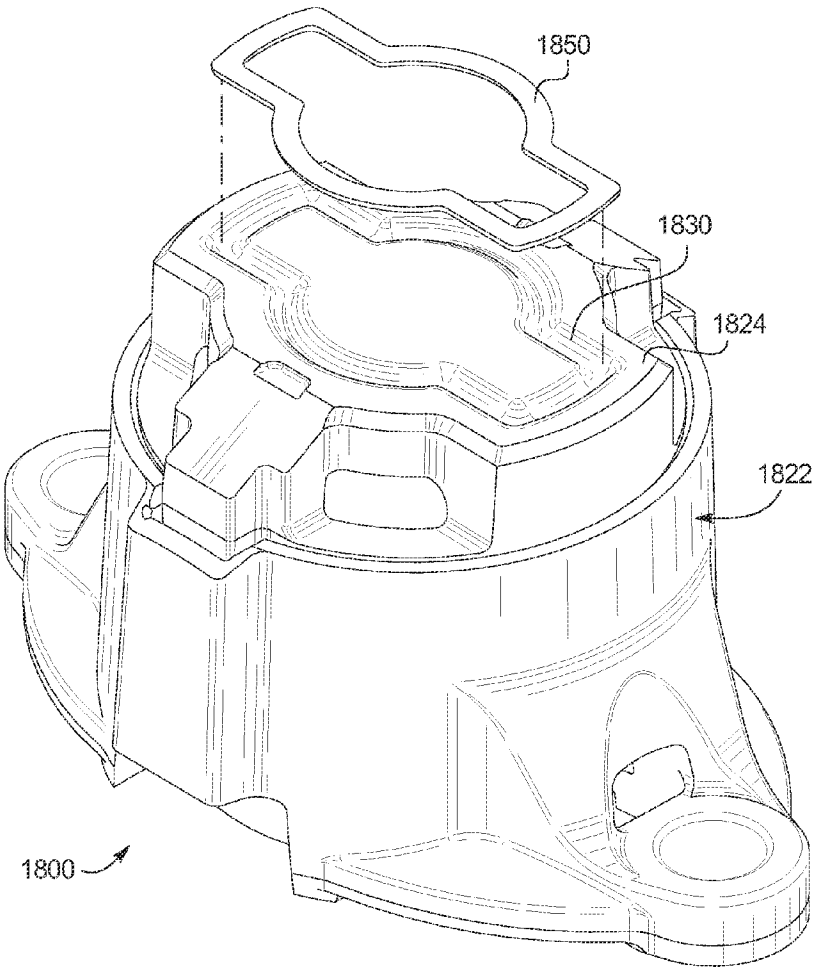
FIG. 21 is an exploded top perspective view of a railroad car constant contact side bearing of another embodiment of the present disclosure having a partially rectangular and partially circular friction modifying insert and corresponding pocket.
Figure 22:
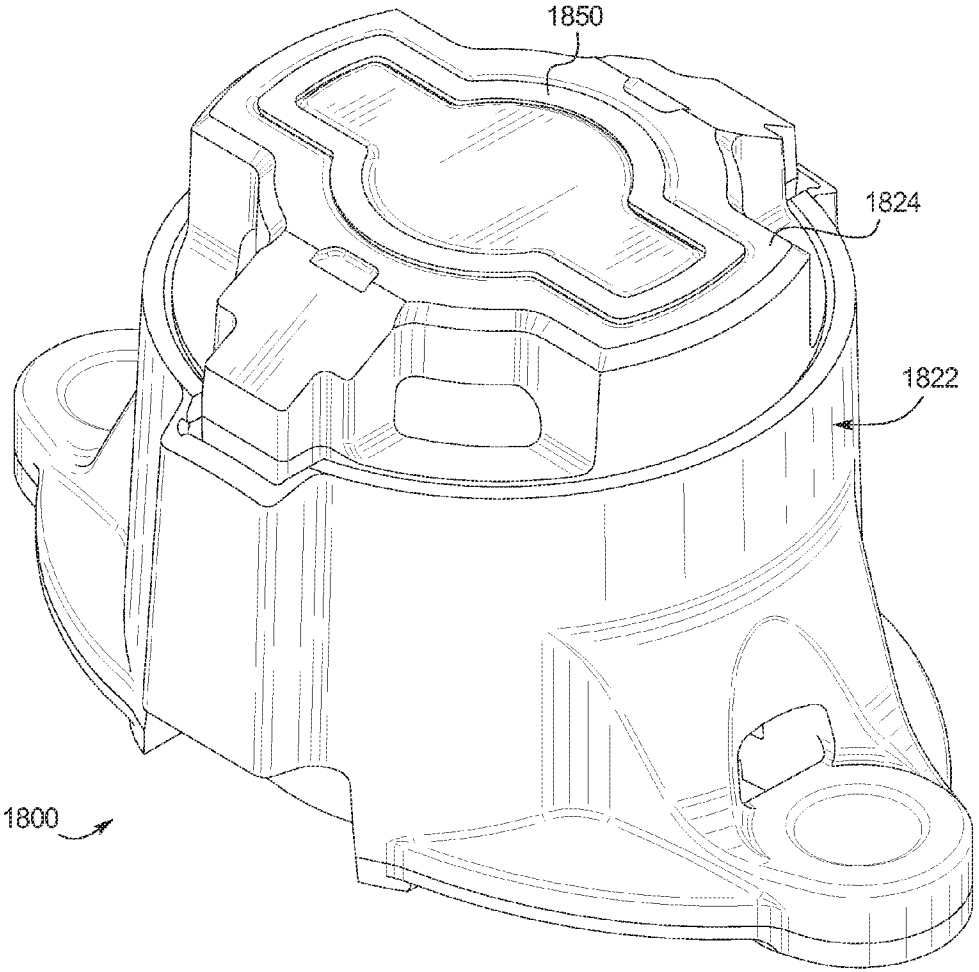
FIG. 22 is a top perspective view of the railroad car constant contact side bearing of FIG. 21 with the partially rectangular and partially circular friction modifying insert mounted in the pocket in the engagement surface.
Figure 22A:
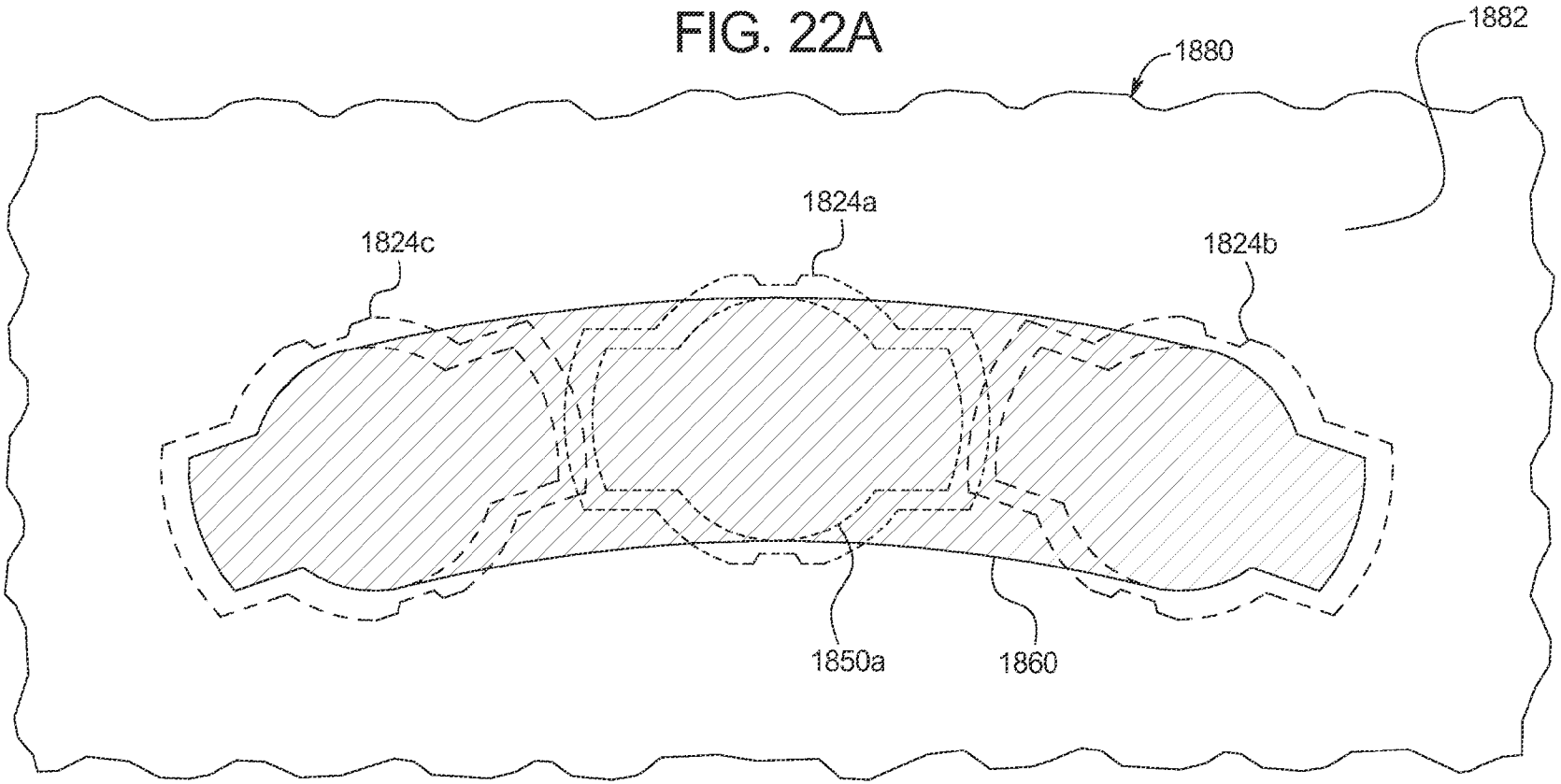
FIG. 22A is a fragmentary bottom view of the underside of the railroad car body, and illustrating the material transfer pattern or lubrication caused by the partially rectangular and partially circular friction modifying insert of the constant contact side bearing of FIGS. 21 and 22.

Referring now to FIGS. 21, 22, and 22A, another example embodiment of the present disclosure is shown in connection with a railroad car constant contact side bearing 1800. This side bearing 1800 includes a body 1822 and an engagement face 1824 on the top of the body 1822. The constant contact side bearing 1800 includes a friction modifying insert 1850 and a corresponding pocket 1830 in the engagement face 1824. In this example embodiment, the friction modifying insert 1850 has an irregular shape, and the pocket 1830 has a corresponding irregular shape, such that the pocket 1830 is configured to receive the back or rear part of the friction modifying insert 1850. The movement of the car body relative to the constant contact side bearing 1800 causes certain of the material (i.e., the transfer material) from the friction modifying insert 1850 to transfer to or coat the inner surface of the underbody and thus form the lubrication layer. FIG. 22A illustrates in phantom the position (indicated by numeral 1850A) of the friction modifying insert when the constant contact side bearing 1800 is first installed in the railroad car truck and thus in the resting or home position relative to the car body. FIG. 22A further illustrates in phantom the range of movement (indicated by numerals 1824*a*, 1824*b*, and 1824*c*) of the car body relative to the engagement face 1824.

Figure 23:
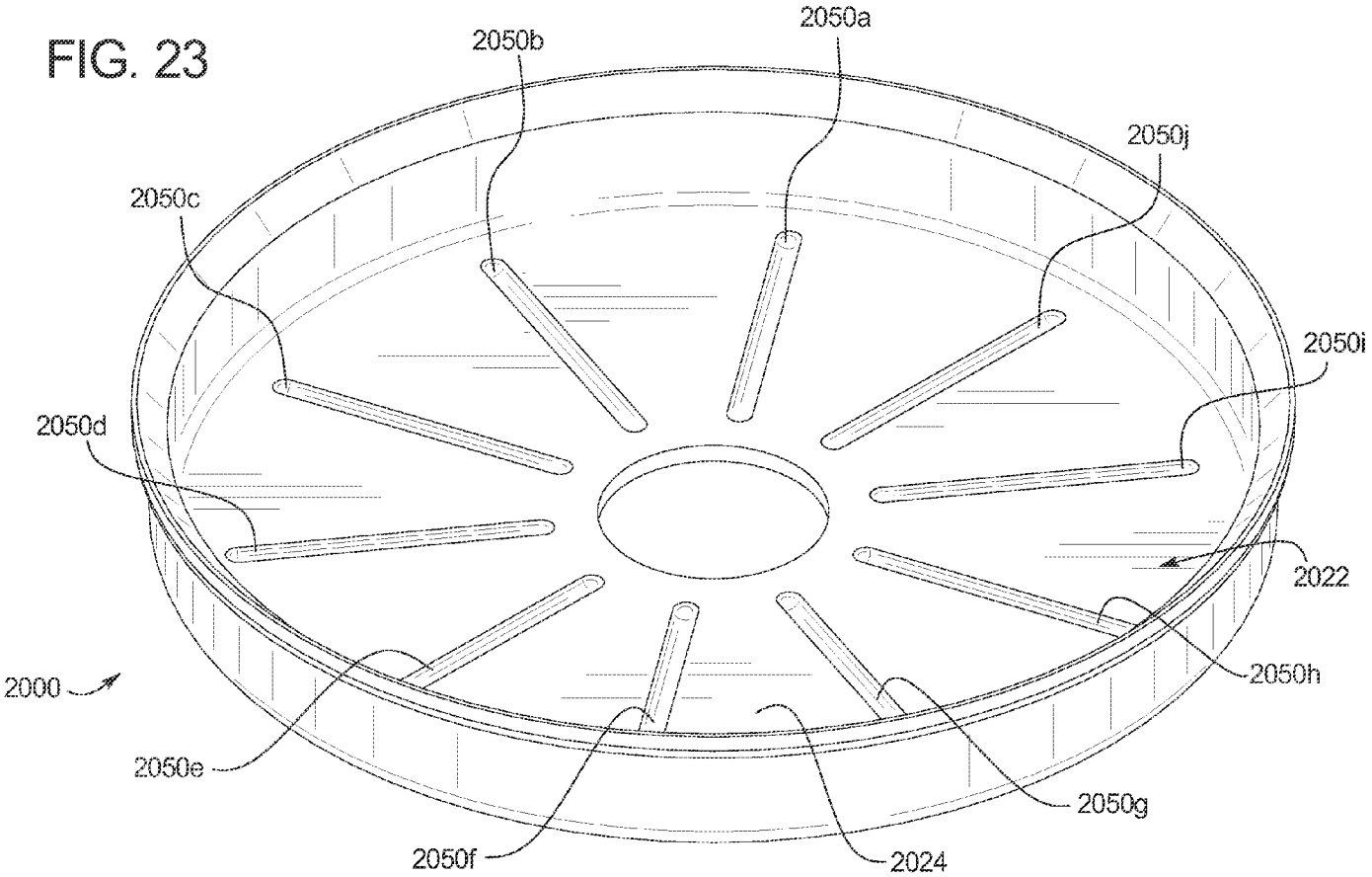
FIG. 23 is a top perspective view of a railroad car truck bolster center bowl liner of another embodiment of the present disclosure having a plurality of spaced apart elongated bar shaped friction modifying inserts positioned in corresponding spaced apart pockets.
Figure 23A:
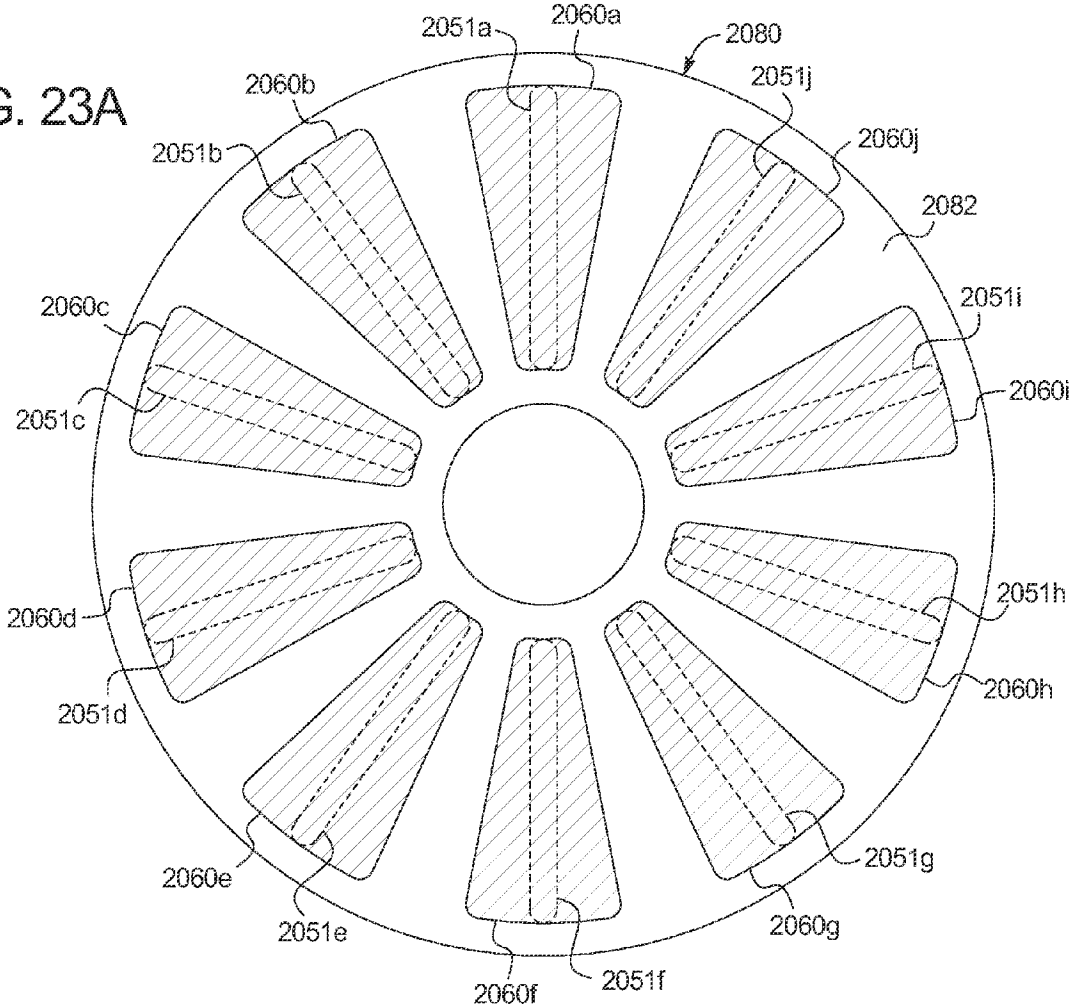
FIG. 23A is a bottom view of the underside of the car body center plate, and showing the material transfer patterns or lubrication caused by the plurality of bar shaped friction modifying inserts of the railroad car bowl liner of FIG. 23.

Referring now to FIGS. 23 and 23A, another example embodiment of the present disclosure is shown in connection with a railroad car truck bolster center bowl liner 2000. This truck bolster center bowl liner 2000 is another example of a railroad car high friction component. This example bowl liner 2000 includes a bottom wall 2022 having a top engagement face 2024. The bowl liner 2000 includes a plurality of friction modifying inserts 2050*a*, 2050*b*, 2050*c*, 2050*d*, 2050*e*, 2050*f*, 2050*g*, 2050*h*, 2050*i*, and 2050*j* positioned in corresponding pockets (not shown) in the engagement face 2024. The engagement face 2024 is a high friction surface because it is configured to be engaged by underside of the body bolster center plate. While the engagement face 2024 is used herein as another example of a high friction surface of the present disclosure, it should be appreciated that the present disclosure is not limited to this truck bolster center bowl liner.

In this example embodiment, the friction modifying inserts 2050*a*, 2050*b*, 2050*c*, 2050*d*, 2050*e*, 2050*f*, 2050*g*, 2050*h*,

2050*i*, and 2050*j* are each an elongated bar, and each of the respective pockets (not shown) has a corresponding shape; such that each pocket is configured to receive the back or rear part of the respective friction modifying insert. The movement of the body bolster center plate 2080 in the bowl liner 2000 causes certain of the material from each of the friction modifying inserts 2050*a*, 2050*b*, 2050*c*, 2050*d*, 2050*e*, 2050*f*, 2050*g*, 2050*h*, 2050*i*, and 2050*j* to transfer to or coat the inner surface of the corresponding surface of the body bolster center plate 2080 and thus form the lubrication layers.

The material transfer patterns 2060*a*, 2060*b*, 2060*c*, 2060*d*, 2060*e*, 2060*f*, 2060*g*, 2060*h*, 2060*j* and 2060*i* formed on the surface 2024 of the bottom surface of the body bolster center plate 2080 caused by the friction modifying inserts 2050*a*, 2050*b*, 2050*c*, 2050*d*, 2050*e*, 2050*f*, 2050*g*, 2050*h*, 2050*i* are generally illustrated in FIG. 23A. More particularly, after installation, when the bowl liner 2000 with the friction modifying inserts 2050*a*, 2050*b*, 2050*c*, 2050*d*, 2050*e*, 2050*f*, 2050*g*, 2050*h*, 2050*i*, and 2050*j* is initially positioned in its working position in the railroad car, the friction modifying inserts 2050*a*, 2050*b*, 2050*c*, 2050*d*, 2050*e*, 2050*f*, 2050*g*, 2050*h*, 2050*i*, and 2050*j* are disposed between the engagement face 2024 of the bowl liner 2050 (i.e., the high friction component) and the corresponding engagement surface of the body bolster center plate 2080. FIG. 23A illustrates in phantom the positions (indicated by numerals 2051*a*, 2051*b*, 2051*c*, 2051*d*, 2051*e*, 2051*f*, 2051*g*, 2051*h*, 2051*i* and 2051*j*) of the friction modifying inserts when the bowl liner 2000 is first installed in the railroad car truck and thus in the resting or home position relative to the car body bolster center plate 2080. When the body bolster center plate 2080 rotates in and relative to the bowl liner 2000, this movement causes certain of the material (i.e., the transfer material) from each of the friction modifying inserts 2050*a*, 2050*b*, 2050*c*, 2050*d*, 2050*e*, 2050*f*, 2050*g*, 2050*h*, 2050*i*, and 2050*j* to transfer to the inner surface 2082 of the body bolster center plate 2080, and more particularly to be spread over or to coat a portion of the engagement surface of the body bolster center plate 2080. This transfer material adheres to the inner surface 2082 of the body bolster center plate 2080 generally in transfer patterns 2060*a*, 2060*b*, 2060*c*, 2060*d*, 2060*e*, 2060*f*, 2060*g*, 2060*h*, 2060*i*, and 2060*j* based on this rotational movement of the body bolster center plate relative to the bowl liner 2000 and based on the shape and size of the friction modifying inserts 2050*a* to 2050*j*. This transfer material forms relatively thin lubrication layers between the bowl liner and the body bolster center plate.

Figure 24:
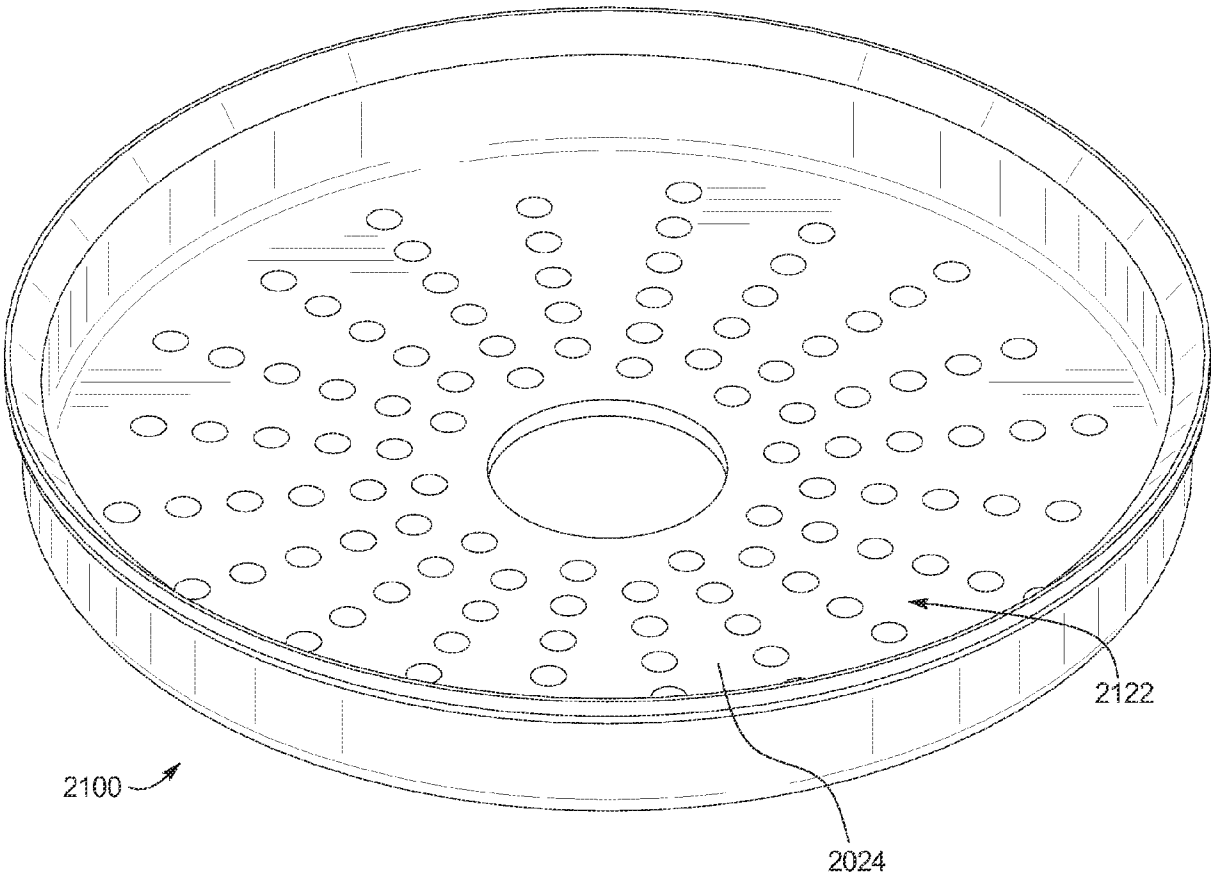
FIG. 24 is a top perspective view of a railroad car truck bolster center bowl liner of another embodiment of the present disclosure having a plurality of spaced apart and aligned cylindrical friction modifying inserts positioned in corresponding spaced apart pockets.

Referring now to FIG. 24, another example embodiment of the present disclosure is shown in connection with a railroad car truck bolster center bowl liner 2100. This bowl liner 2100 includes a bottom wall 2122 and an engagement face 2124 on the top of the body 2122. The bowl liner 2100 includes a plurality of friction modifying inserts (not labeled) and corresponding pockets (not shown or labeled) in the engagement face 2124. In this example embodiment, the friction modifying inserts are cylindrical, and the pockets each have a corresponding cylindrical shape, such that each pocket is configured to receive the back or rear part of one of the friction modifying inserts. The rotation of the body bolster center plate relative to the bowl liner 2100 causes certain of the material (i.e., the transfer material) from the friction modifying inserts to transfer to or coat the inner surface of the corresponding body bolster center plate and thus form the lubrication layers.

Referring now to FIGS. 25, 25A, 26, and 26A, another example embodiment of the present disclosure is shown in connection with a railroad car brake beam extension head 2200. This brake beam extension head is another example of a railroad car high friction component. This example brake beam extension head 2200 includes top wall 2222*a* and a bottom wall 2222*b* which respectively have engagement faces 2224*a* and 2224*b*. The brake beam extension head 2200 includes: (a) a plurality of friction modifying inserts 2251 and 2252 and corresponding pockets (not shown or labeled) in the engagement face 2224*a*; and (b) a plurality of friction modifying inserts 2254 and 2256 and corresponding pockets (not shown or labeled) in the engagement face 2224*b*. The engagement faces 2224*a* and 2224*b* are high friction surfaces because they are configured to engage the top and bottom walls of a brake beam guide wear plate extending from the truck. While the engagement face 2224*a* and 2224*b* are used herein as another example of high friction surfaces of the present disclosure, it should be appreciated that the present disclosure is not limited to this brake beam extension head.

In this example embodiment, the friction modifying inserts 2250, 2252, 2254, and 2256 are each an elongated bar, and each of the respective pockets (not shown or labeled) has a corresponding shape, such that each pocket is configured to receive the back or rear part of the respective friction modifying insert. The back and forth movement of the brake beam extension head relative to and in the brake beam guide wear plate causes certain of the material (i.e., the transfer material) from the friction modifying inserts to transfer to or coat the inner surface of the corresponding wall of the brake beam guide wear plate.

Figure 25:
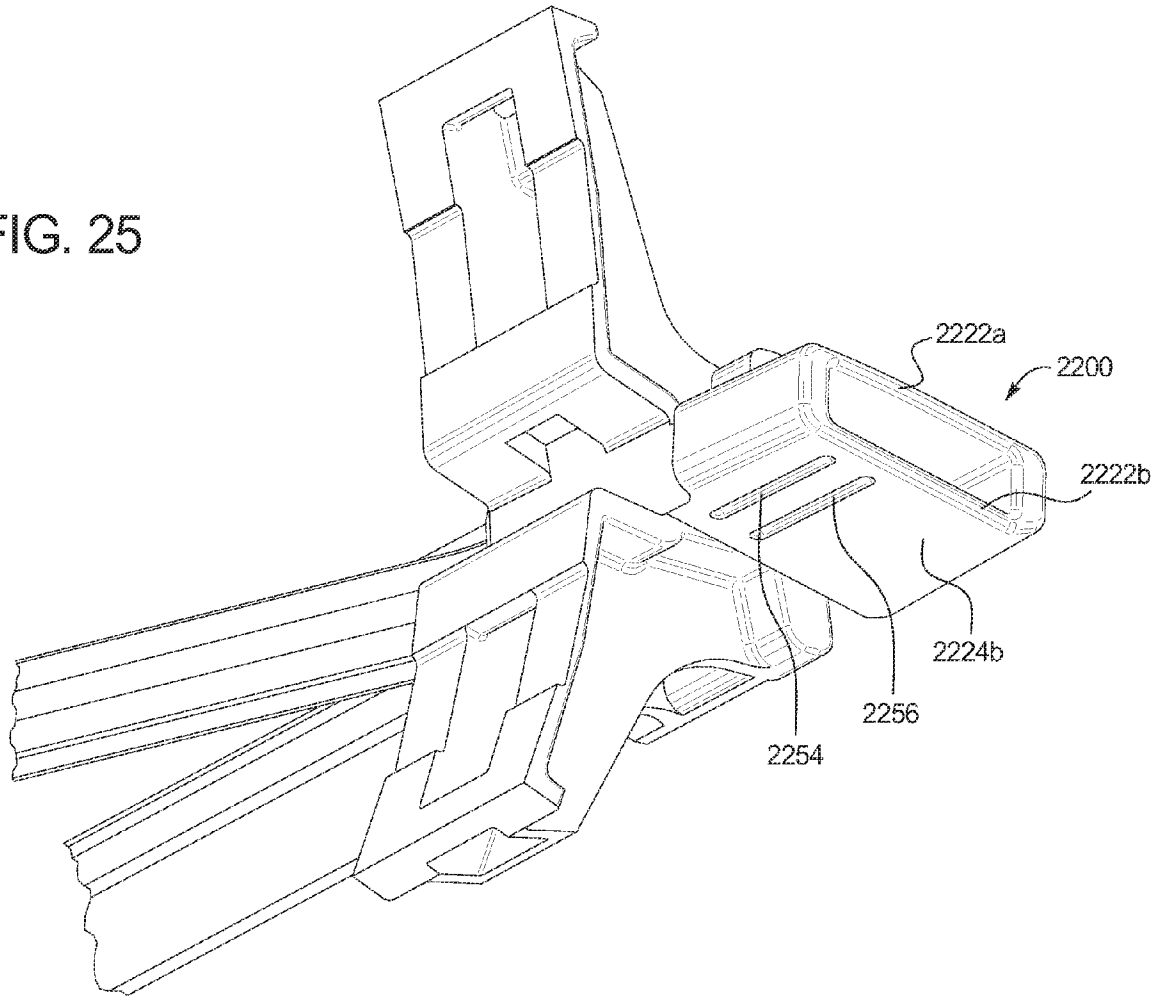
FIG. 25 is a bottom perspective view of a railroad car brake beam extension head of another embodiment of the present disclosure having a plurality of spaced apart bar shaped friction modifying inserts positioned in corresponding spaced apart pockets.
Figure 25A:
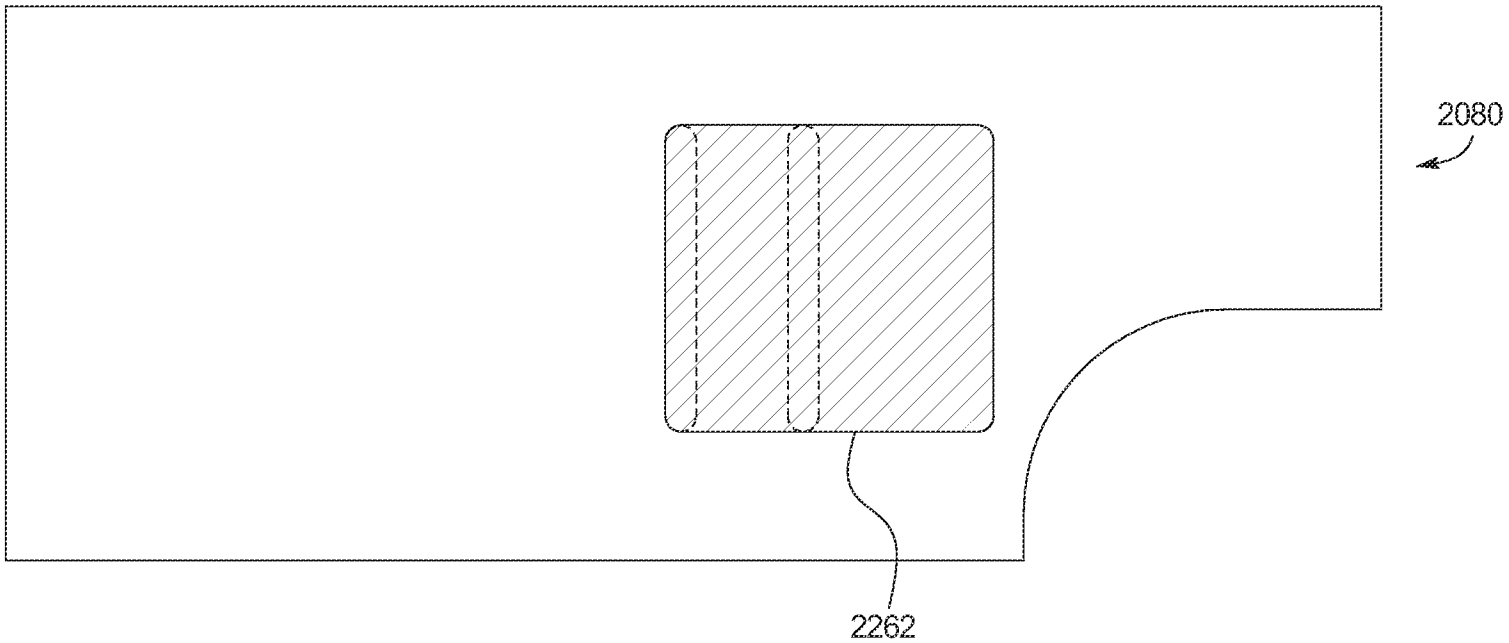
FIG. 25A is a top view of the bottom wall of the brake beam guide wear plate for the railroad car brake beam extension head of FIG. 25, and illustrating the material transfer pattern or lubrication caused by the plurality of bar shaped friction modifying inserts of the brake beam extension head of FIG. 25.
Figure 26:
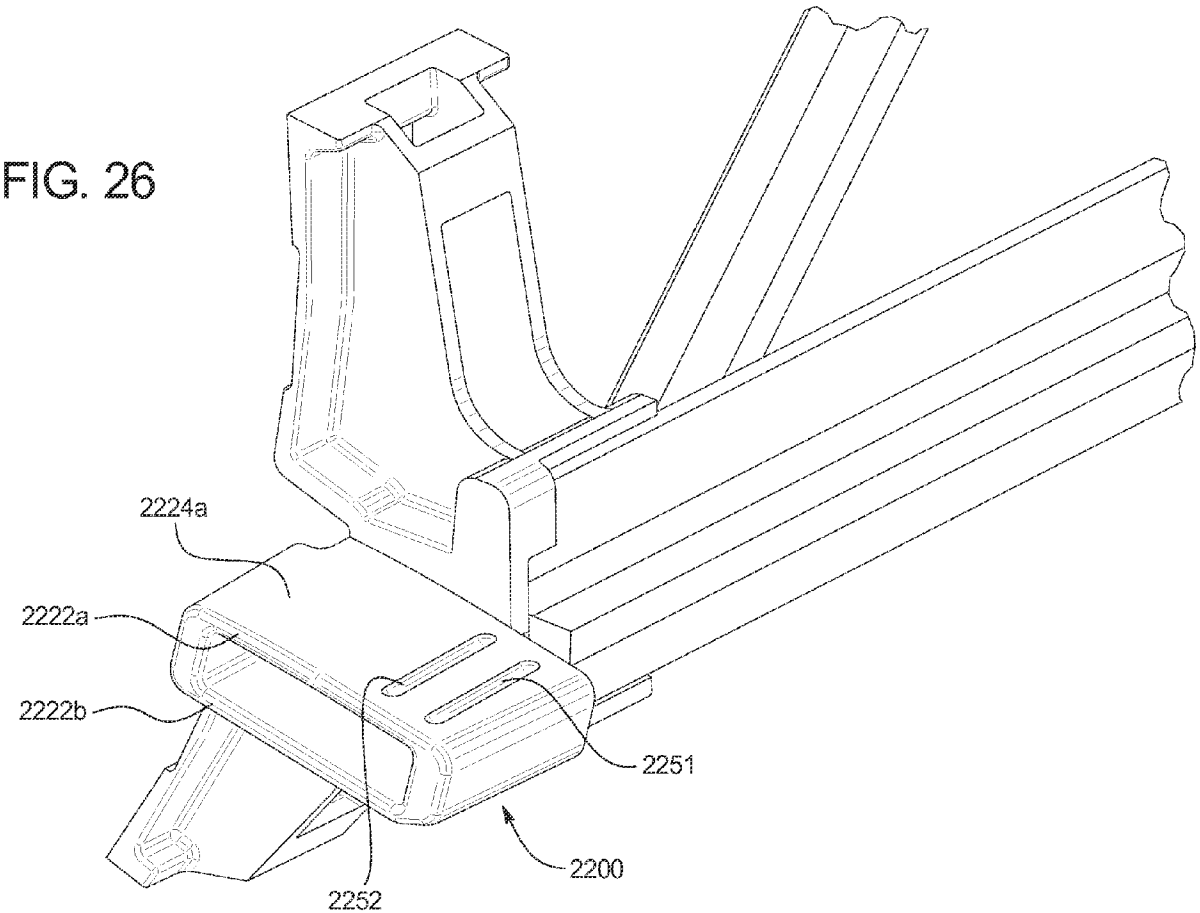
FIG. 26 is a top perspective view of the railroad car brake beam extension head of FIG. 25 having a plurality of spaced apart bar shaped friction modifying inserts positioned in corresponding spaced apart pockets.
Figure 26A:
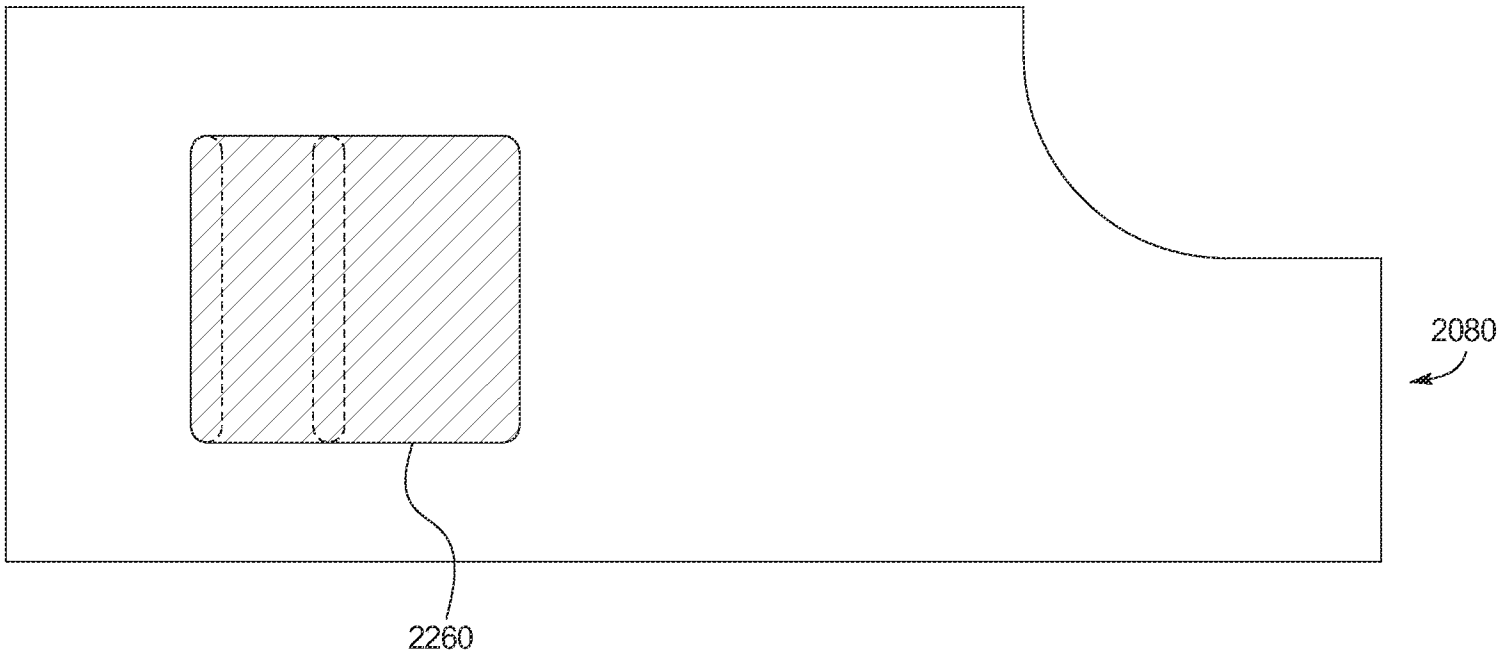
FIG. 26A is a bottom view of the bottom wall of the brake beam guide wear plate for the brake beam extension head of FIG. 26, and illustrating the material transfer pattern or lubrication caused by the plurality of bar shaped friction modifying inserts of the railroad car brake beam extension head of FIG. 26.

The material transfer patterns 2260 and 2262 on the inner surfaces of the brake beam guide wear plate 2080 caused by the brake beam extension head 2250 are generally illustrated in FIGS. 25A and 26A. More particularly, after installation, when the brake beam extension head 2200 with the friction modifying inserts 2250, 2252, 2254, and 2256 is initially positioned in its working position in the railroad car, the friction modifying inserts are respectively disposed between the engagement faces 2224*a* and 2224*b* of the brake beam extension head (i.e., the high friction component) and the corresponding engagement surfaces of the brake beam guide wear plate. When the brake beam extension head moves back and forth in the brake beam guide wear plate, this movement causes certain of the material from the friction modifying inserts to transfer to the inner surfaces of the brake beam guide wear plate, and more particularly to be spread over or to coat a portion of the engagement surface of the brake beam guide wear plate 2280. This transfer material adheres to the inner surfaces of the brake beam guide wear plate generally in transfer patterns based of this movement the brake beam extension heads relative to the brake beam guide wear plate and based on the shape and size of the friction modifying inserts. This transferred material forms a relatively thin lubrication layer between the brake beam extension head and the brake beam guide wear plate.

It should be appreciated that as the high friction component and the corresponding component wear due to the desired friction between these components (e.g., such as the desired friction between two engaging steel components) additional portions (i.e., lower layers) of the friction modifying insert(s) will be exposed and such exposed additional portions will continue to coat these worn engaging components. In certain embodiments, depending on the size of the pocket(s) and the friction modifying insert(s), the high friction component can be worn down to or close to the bottom of the pocket(s) while the friction modifying insert(s) continues to provide lubrication between these components. In certain embodiments, the high friction component would be replaced when the friction modifying insert(s) is completely or almost completely worn out. It should also be appreciated that in one sense the friction modifying inserts of the present disclosure thus provide a self applying lubrication and thus a self applying friction control between these engaging components.

It will be understood that modifications and variations may be effected without departing from the scope of the novel concepts of the present invention, and it is understood that this application is to be limited only by the scope of the claims.

The invention is claimed as follows:

1. A high friction railroad car component for a railroad car, said component comprising:

a body having a high friction surface, said surface defining a plurality of spaced apart friction modifying insert receiving pockets, said surface configured to engage a surface of a corresponding component; and a plurality of separate friction modifying inserts respectively positioned in said pockets, such that when said high friction surface engages said same surface of the corresponding component for a period of time during use of the railroad car, each of said friction modifying inserts provides a lubrication layer in a transfer pattern on the same surface of the corresponding component.

2. The high friction railroad car component of claim 1, wherein at least one of the friction modifying insert receiving pockets is disposed generally transverse to a direction of movement of said body.

3. The high friction railroad car component of claim 1, wherein at least two of the plurality of friction modifying insert receiving pockets have different shapes, and at least two of the plurality of friction modifying inserts have different shapes.

4. The high friction railroad car component of claim 1, wherein each of the friction modifying inserts are one of a nylon, a graphite, a urethane, and an oil-filled urethane.

5. The high friction railroad car component of claim 1, wherein the friction modifying inserts are each an ultra high molecular weight polyethylene friction modifying insert.

6. The high friction railroad car component of claim 1, wherein the body is part of one of a friction wedge, a constant contact side bearing, a bowl liner, a roller bearing adapter, a roller bearing adapter liner, and a side bearing wall.

7. The high friction railroad car component of claim 1, wherein at least one of the friction modifying inserts has one of: a cylindrical shape, an I shape, an H shape, an X shape, and a t shape or cross shape; and at least one of the pockets has a corresponding one of: a cylindrical shape, an I shape, an H shape, an X shape, and a t shape or cross shape.

8. The high friction railroad car component of claim 1, wherein at least one of the friction modifying inserts is pressure fit in the respective pocket.

9. The high friction railroad car component of claim 1, wherein at least on the friction modifying inserts is held in the respective pocket by a section of tape.

10. The high friction railroad car component of claim 1, wherein at least one of the friction modifying inserts is held in the respective pocket by an adhesive.

11. The high friction railroad car component of claim 1, wherein at least one of the friction modifying inserts is held in the respective pocket by one or more surfaces of said pocket.

12. The high friction railroad car component of claim 1, wherein the at least one of the friction modifying insert receiving pocket is disposed generally transverse to a direction of movement of said body.

13. A high friction railroad car component for a railroad car, said component comprising:

a body having a high friction surface having a surface area, said surface defining at least one friction modifying insert receiving pocket, said surface configured to engage a surface of a corresponding component, wherein the body is part of one of a friction wedge, a constant contact side bearing, a bowl liner, a roller bearing adapter, a roller bearing adapter liner, and a side bearing wall; and a friction modifying insert having a surface area substantially smaller than the surface area of the high friction surface, said friction modifying insert positioned in said pocket, such that when said high friction surface engages said surface of the corresponding component for a period of time during use of the railroad car, said friction modifying insert provides a lubrication layer in a transfer pattern on the surface of the corresponding component.

14. The high friction railroad car component of claim 13, which includes a plurality of friction modifying insert receiving pockets, and a plurality of corresponding friction modifying inserts in said pockets, said friction modifying inserts having a surface area substantially smaller than the surface area of the high friction surface.

15. The high friction railroad car component of claim 14, wherein at least two of the plurality of friction modifying insert receiving pockets have different shapes, and at least two of the plurality of friction modifying inserts have different shapes.

16. The high friction railroad car component of claim 13, wherein the friction modifying insert positioned in said pocket extends a predetermined distance at initial installation from an engagement surface of the body.

17. The high friction railroad car component of claim 13, wherein the friction modifying insert is one of a nylon, a graphite, a urethane, and an oil-filled urethane.

18. The high friction railroad car component of claim 13, wherein the friction modifying insert is an ultra high molecular weight polyethylene friction modifying insert.

19. The high friction railroad car component of claim 13, wherein the friction modifying insert has one of: a cylindrical shape, an I shape, an H shape, an X shape, and a t shape or cross shape; and the pocket has a corresponding one of: a cylindrical shape, an I shape, an H shape, an X shape, and a t shape or cross shape.

20. The high friction railroad car component of claim 13, wherein the friction modifying insert is pressure fit in the pocket.

21. The high friction railroad car component of claim 13, wherein the friction modifying insert is held in the pocket by a section of tape.

22. The high friction railroad car component of claim 13, wherein the friction modifying insert is held in the pocket by an adhesive.

23. The high friction railroad car component of claim 13, wherein the friction modifying insert is held in the pocket by one or more surfaces of said pocket.

24. A high friction railroad car component for a railroad car, said component comprising:

a body having a high friction surface having a surface area, said surface defining at least one friction modifying insert receiving pocket, said surface configured to engage a surface of a corresponding component; and a friction modifying insert having a surface area substantially Smaller than the surface area of the high friction surface, said friction Modifying insert positioned in said pocket, such that when said high friction surface engages said surface of the corresponding component for a period of time during use of the railroad car, said friction modifying insert provides a lubrication layer in a transfer pattern on the surface of the corresponding component, said friction modifying insert having one of: a cylindrical shape, an I shape, an H shape, an X shape, and a t shape or cross shape. and said pocket having a corresponding one of: a cylindrical shape, an I shape, an H shape, an X shape, and a t shape or cross shape.

25. The high friction railroad car component of claim 24, wherein the at least one of the friction modifying insert receiving pockets is disposed generally transverse to a direction of movement of said body.

26. The high friction railroad car component of claim 24, which includes a plurality of friction modifying insert receiving pockets, and a plurality of corresponding friction modifying inserts in said pockets, said friction modifying inserts having a surface are substantially smaller than the surface area of the high friction surface.

27. The high friction railroad car component of claim 26, wherein at least two of the plurality of friction modifying insert receiving pockets have different shapes, and at least two of the plurality of friction modifying inserts have different shapes.

28. The high friction railroad car component of claim 24, wherein the friction modifying insert positioned in said pocket extends a predetermined distance at initial installation from an engagement surface of the body.

29. The high friction railroad car component of claim 24, wherein the friction modifying insert is one of a nylon, a graphite, a urethane, and an oil-filled urethane.

30. The high friction railroad car component of claim 24, wherein the friction modifying insert is an ultra high molecular weight polyethylene friction modifying insert.

31. The high friction railroad car component of claim 24, wherein the body is part of one of a friction wedge, a constant contact side bearing, a bowl liner, a roller bearing adapter, a roller bearing adapter liner, and a side bearing wall.

32. The high friction railroad car component of claim 24, wherein the friction modifying insert is pressure fit in the pocket.

33. The high friction railroad car component of claim 24, wherein the friction modifying insert is held in the pocket by section of tape.

34. The high friction railroad car component of claim 24, wherein the friction modifying insert is held in the pocket by an adhesive.

35. The high friction railroad car component of claim 24, wherein the friction modifying insert is held in the pocket by one or more surfaces of said pocket.

* * * * *